US008067143B2

(12) United States Patent
Kikawa et al.

(10) Patent No.: US 8,067,143 B2
(45) Date of Patent: Nov. 29, 2011

(54) FUNCTIONAL PARTICLE AND MANUFACTURING METHOD THEREOF

(75) Inventors: Keiichi Kikawa, Osaka (JP); Katsuru Matsumoto, Nara (JP); Nobuhiro Maezawa, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 1068 days.

(21) Appl. No.: 11/898,005

(22) Filed: Sep. 7, 2007

(65) Prior Publication Data

US 2008/0063970 A1 Mar. 13, 2008

(30) Foreign Application Priority Data

Sep. 8, 2006 (JP) ..... P2006-244724

(51) Int. Cl.
*G03G 9/093* (2006.01)

(52) U.S. Cl. ..... 430/137.12; 430/137.11; 430/137.14

(58) Field of Classification Search ..... 430/137.11, 430/137.14, 137.12
See application file for complete search history.

(56) References Cited

U.S. PATENT DOCUMENTS

| | | | | |
|---|---|---|---|---|
| 5,424,162 | A | 6/1995 | Kohri et al. | |
| 5,552,502 | A | 9/1996 | Odell et al. | |
| 5,725,987 | A | 3/1998 | Combes et al. | |
| 5,843,614 | A | 12/1998 | Shinzo et al. | |
| 5,885,743 | A | 3/1999 | Takayanagi et al. | |
| 6,017,670 | A | 1/2000 | Hashizume et al. | |
| 6,270,708 | B1 | 8/2001 | Gurol | |
| 6,858,369 | B1 | 2/2005 | Adachi et al. | |
| 7,284,899 | B2 | 10/2007 | Nakano | |
| 7,402,371 | B2 | 7/2008 | Sacripante et al. | |
| 7,575,843 | B2 | 8/2009 | Matsumoto et al. | |
| 2002/0039699 | A1* | 4/2002 | Nishimori et al. | 430/137.11 |
| 2002/0042014 | A1 | 4/2002 | Fujino et al. | |
| 2002/0160289 | A1 | 10/2002 | Teshima et al. | |
| 2002/0192587 | A1* | 12/2002 | Matsumura et al. | 430/110.4 |
| 2004/0110078 | A1 | 6/2004 | Teshima et al. | |
| 2005/0041523 | A1* | 2/2005 | Nakano | 366/176.1 |
| 2006/0160012 | A1 | 7/2006 | Hirose et al. | |
| 2007/0020553 | A1 | 1/2007 | Marcello et al. | |
| 2007/0128533 | A1 | 6/2007 | Sata et al. | |
| 2007/0166638 | A1 | 7/2007 | Matsumoto et al. | |
| 2007/0196754 | A1 | 8/2007 | Matsumoto et al. | |
| 2008/0029924 | A1 | 2/2008 | Maezawa et al. | |

(Continued)

FOREIGN PATENT DOCUMENTS

CN 1408079 A 4/2003

(Continued)

OTHER PUBLICATIONS

Translation of JP 63-278547 published Nov. 1988.*

(Continued)

*Primary Examiner* — Peter Vajda
(74) *Attorney, Agent, or Firm* — Nixon & Vanderhye P.C.

(57) ABSTRACT

A functional particle is manufactured by a method including an aggregating step, a depressurizing step, and a cooling step. In the aggregating step, the functional particle is obtained by flowing a mixed slurry containing a core particle and a shell particle through a coiled pipeline while heating the mixed slurry to a glass transition temperature or higher of the core particle, to deposit the shell particles on the surface of the core particle. In the depressurizing step, the grain size of the functional particle is controlled and the coarse particle is pulverized to make the grain size of the functional particles uniform. In the cooling step, re-aggregation of the functional particles with unified grain size is prevented.

5 Claims, 5 Drawing Sheets

U.S. PATENT DOCUMENTS

| | | | |
|---|---|---|---|
| 2008/0063970 | A1 | 3/2008 | Kikawa et al. |
| 2009/0042119 | A1 | 2/2009 | Matsumoto et al. |
| 2010/0021210 | A1 | 1/2010 | Maezawa et al. |

FOREIGN PATENT DOCUMENTS

| | | | | |
|---|---|---|---|---|
| CN | 1615175 | A | | 5/2005 |
| JP | 63-278547 | | * | 11/1988 |
| JP | 03-056969 | | | 3/1991 |
| JP | 04-174861 | | | 6/1992 |
| JP | 07-075666 | | | 8/1995 |
| JP | 08-146657 | | | 6/1996 |
| JP | 09-277348 | | | 10/1997 |
| JP | 10-186714 | | | 7/1998 |
| JP | 63-278547 | A | | 11/1998 |
| JP | 2001-209212 | | | 8/2001 |
| JP | 2001-324831 | | | 11/2001 |
| JP | 2002-351140 | A | | 12/2002 |
| JP | 2003-066649 | | | 3/2003 |
| JP | 2003-345063 | A | | 12/2003 |
| JP | 2005-128176 | | | 5/2005 |
| JP | 2005-165039 | | | 6/2005 |
| JP | 2006-91882 | | | 4/2006 |
| JP | 2006-189710 | | | 7/2006 |
| JP | 2007-34290 | A | | 2/2007 |
| JP | 2007-108458 | | | 4/2007 |
| JP | 2007-219451 | | | 8/2007 |
| WO | 01/84248 | A1 | | 11/2001 |
| WO | 03/059497 | | | 7/2003 |
| WO | WO 03/059497 | | | 7/2003 |

OTHER PUBLICATIONS

U.S. Office Action mailed Nov. 21, 2008 in corresponding U.S. Appl. No. 11/652,482.

* cited by examiner

FUNCTIONAL PARTICLE AND MANUFACTURING METHOD THEREOF

CROSS-REFERENCE TO RELATED APPLICATION

This application claims priority to Japanese Patent Application No. 2006-244724, which was filed on Sep. 8, 2006, the contents of which are incorporated herein by reference in its entirety.

BACKGROUND OF THE INVENTION

1. Field of the Invention

The present invention relates to a functional particle and a method of manufacturing the same.

2. Description of the Related Art

A toner used for elecrophotographic image formation contains a binder resin, a colorant, a release agent and the like. A typical method of manufacturing the toner includes a pulverization method. According to the pulverization method, a toner of an infinite form is manufactured by cooling to solidify a molten kneaded product of a binder resin, a colorant, a wax and the like and mechanically pulverizing the obtained solidification product. In the toner, since a fractured surface during pulverization appears on the surface, the colorant is often exposed to the surface. Since the colorant exposed to the surface gives an effect on the charging performance of the toner, this varies the charging performance of the toner. As a result, image defects such as unevenness in images tends to occur and images at high quality cannot be formed. It is extremely difficult to control the surface state of the toner in the reduction of the particle size by pulverization. For making the charging performance of the toner uniform, it is important that the colorant is not exposed to the toner surface. Further, it is important that the shape of the toner is uniform and the width of the grain size distribution is narrow.

Further, the release agent contained in the toner has a property of bleeding out to the toner surface with time. Since the release agent has tackiness, it tends to cause aggregation (blocking) between the toners. In a case of using a two-component developer containing a toner and a carrier, a phenomenon referred to as filming in which the release agent in deposited to the carrier surface occurs, which deteriorates the carrier and makes charging of the toner insufficient. On the other hand, the amount of the release agent in the toner is decreased by the bleed-out of the release agent. Accordingly, this tends to frequently generate an offset phenomenon that the toner is deposited not to the recording medium but to a fixing roller as a member for fusing toner images to the recording medium, to lower the fixing property of the toner to the recording medium. For eliminating the blocking, filming and offset phenomena, it is important to prevent bleed-out of the release agent to the toner surface. Further, for reducing the power consumption, a toner containing a binder resin having a relatively lower glass transition temperature and with low fixing temperature has been developed. However, since the binder resin tends to be softened by heat, the toner tends to cause blocking. In a case of using this toner, since the range for the possible fixing temperature is narrowed, it requires to conduct temperature control accurately during fixing which renders the control complicated during fixing. In order to eliminate blocking, it is important to prevent toner from being in contact with each other in a state where the binder resin is softened.

In view of the foregoing problems, an encapsulated toner in which a coating layer is formed on the toner surface has attracted attention. In a case of forming the coating layer on the toner surface, it is possible to conceal the colorant exposed to the toner surface, reduce the bleed-out of the release agent and, further, prevent contact between the toners in the softened state. Accordingly, various proposals have made for the encapsulated toner. For example, an encapsulated toner obtained by spraying a methylethyl ketone solution of polybutadiene to the periphery of a core material by a spray drying method and removing a solvent in a high temperature air is proposed (for example, refer to Japanese Unexamined Patent Publication JP-A 4-174861 (1992). However, the spray drying method inevitably forms coarse coagulates and increases the width of the grain size distribution to vary the charging performance of the toner. Further, by the manufacturing method of JP-A 4-174861, a great amount of vapors of methylethyl ketone as an organic solvent is formed, which cannot be exhausted as it is in atmospheric air. Therefore, it needs a special recovery facility and is not suitable to production in an industrial scale.

Further, an encapsulated toner containing a colored resin particle as a granulation product of a binder resin containing a colorant (core particle), a release agent layer formed to the surface of the colorant resin particle and a resin coating layer formed on the surface of the release agent layer and comprising resin particle for encapsulation (shell particle) has been proposed (for example, in Japanese Unexamined Patent Publication JP-A 2001-324831). According to the technique of JP-A 2001-324831, a precursor particles for core particle in which a colorant and a release agent not compatible with the binder resin are dispersed in the binder resin is at first prepared by a pulverization method. A resin particle for encapsulation is deposited on the surface of the precursor particles by a mechanical impact force or dry mechanochemical method. Then, the precursor particle deposited with the resin particle for encapsulation is exposed to a hot air stream to fuse the resin particle for encapsulation to the precursor particle to form a resin coating layer. At the same time, the release agent is leached from the precursor particle to make the precursor particles into a colored resin particle, and a release agent layer is formed between the colored resin particle and the resin coating layer to prepare an encapsulated toner of JP-A 2001-324831. However, since the mechanical impact force or dry mechanochemical method has to be applied in an air stream at low particle concentration and the production efficiency is low, it is not suitable to the production in an industrial scale. Further, the resin coating surface is not sometimes formed over the entire surface of the colored resin particle to possibly vary the charging performance by the surface exposure of the colorant, etc.

On the other hand, a wet method of manufacturing a toner by utilizing an aggregating effect of particles in an aqueous medium has also been well known. The advantage of the wet method is that the shape of the obtained toner is uniform, and the width of the grain size distribution is relatively narrowed. That is, problems in the toner may possibly be overcome all at once by preparing the encapsulated toner by the wet method. For example, it has been proposed a manufacturing method of mixing a toner raw material mixture containing a resin exhibiting dispersibility to water by a neutralizing agent (hereinafter referred to as "self-dispersible resin), a colorant, a fine wax particle, and an organic solvent, and an aqueous medium under the presence of a neutralizing agent and conducting phase-inversion emulsification (for example, refer to Japanese Unexamined Patent Application JP-A 10-186714 (1998)). According to the manufacturing method of JP-A 10-186714, an encapsulated toner as a self-dispersible resin particle incorporating the colorant and a wax fine particle is obtained. The manufacturing method involves a problem that aggregation of the colorant tends to occur upon mixing the toner raw material mixture and the aqueous medium due to the less dispersibility of the colorant to water. The coagulant of the colorant induces aggregation of resin particles. Further, aggregation of the colorant varies the colorant content in the finally obtained encapsulated toner to make the charging performance not uniform.

Further, it has been proposed a method of manufacturing an encapsulated particle by batchwise treating a primary particle (core particle) and a secondary particle (shell particle) by a homogenizer and aggregating the secondary particles to the surface of the primary particle (for example, Japanese Unexamined Patent Publication JP-A 63-278547 (1988)). The number average particle size of the primary particle (core particle) is from 0.1 to 100 μm. The number average particle size of the secondary particle is ⅕ or less of the number average particle size of the primary particle. The spray pressure in the homogenizer treatment is 29.4 MPa (300 kgf/cm$^2$) or more. In the technique of JP-A 63-278547, it is necessary to pressurize at 54.8 MPa or higher in order to prevent the occurrence of excess aggregation and obtain a particle of uniform grain size. The homogenizer used in the technique of JP-A 63-278547 is a homogenizer, for example, of a type of colliding a dispersion product at a high pressure against each other (for example, microfluidizer) or a homogenizer of a type of colliding a dispersion product at a high pressure against the inner wall (for example, Manton Gaulin homogenizer) according to JP-A 63-278547, p3, column 5, lines 8 to 18. Since each of the homogenizers has no coiled pipeline, less centrifugal force is added even when the shearing force is added. Accordingly, aggregation occurs between the primary particles to each other or between secondary particles to each other and the aimed encapsulated particles cannot be obtained by a yield at an industrially satisfactory level. In addition, the grain size of the obtained encapsulated particles is not uniform and the width of the grain size distribution is broad. Further, in the technique of JP-A 63-278547, since aggregation is conducted at a high pressure of 29.4 MPa or higher and at 54.8 MPa or higher depending on the case, a pressure proof facility and an arresting facility are indispensable for the practice of an industrial scale and increase in the size of the homogenizer is also required, so that this is not a practical method. Further, since only the secondary particles having a volumic average grain size ⅕ or less of the volumic average particle size of the primary particle can be used, usable secondary particles are restricted.

SUMMARY OF THE INVENTION

An object of the invention is to provide an industrially advantageous manufacturing method capable of manufacturing a functional particle in which a shell particle of a grain size smaller than that of a core particle is deposited uniformly on the surface of the core particle to form a coating layer, and which is uniform in shape, has properly reduced diameter, and has a narrow range in grain size distribution and less fluctuation in properties at a good yield, as well as a functional particle that can be obtained by the manufacturing method.

The invention provide a method of manufacturing a functional particle comprising a step of flowing a mixed slurry containing a core particle as a resin particle and a shell particle of a resin particle or inorganic particle having a volume average particle size less than that of the core particle through a coiled pipeline while heating the mixed slurry to a glass transition temperature or higher of the core particle, thereby obtaining a functional particle in which the shell particle is deposited on a surface of the core particle.

According to the invention is provided a method of manufacturing a functional particle comprising a step of flowing a mixed slurry containing a core particle as a resin particle and a shell particle having a volume average grain size smaller than that of the core particle while heating the mixed slurry to a glass transition temperature or higher of the core particle through a coiled pipeline. The step of flowing the mixed slurry through the coiled pipeline under a glass transition temperature or higher of the core particle can also be referred to as "aggregating step". According to the manufacturing method of the invention, since aggregation between the core particles to each other or between the shell particles to each other scarcely occurs and only the aggregation occurs selectively between the core particle and the shell particle, a functional particle in which the shell particles are deposited uniformly on the surface of the core particle can be manufactured at a good yield. The functional particle is uniform in the shape, moderately reduced in the diameter (for example, from 5 to 7 μm), narrow in the width of the grain size distribution, and less fluctuates in the property. Further, as has been described above, since the selective aggregation of particles occurs by a relative simple and convenient constitution of heating to a specific temperature and flowing through the coiled pipeline, it is easy for the step control and the scale-up of the step. Accordingly, the manufacturing method of the invention is advantageous for practice in an industrial scale.

Further, in the invention, it is preferable that the manufacturing method further comprises:

a depressurizing step of reducing a pressure of a slurry containing functional particles so as not to cause bubbling due to bumping and;

a cooling step of cooling the slurry containing the functional particles.

According to the invention, the manufacturing method preferably comprises a depressurizing step and a cooling step together with the aggregating step. Since heating is applied in the aggregating step to a temperature of a glass transition temperature or higher of the core particle, this may leave a possibility that core particles are coagulated to each other to form coarse particles. When the slurry containing such coarse particles together with the functional particles is depressurized so as not to cause bubbling due to bumping in the depressurizing step, only the core particles are separated selectively in the coarse particles. While the coarse particles are formed by heating in the depressurizing step, since heating temperature is higher utmost by about 5 to 10° C. than the glass transition temperature, softening of the core particles is not so remarkable as causing fusion. Therefore, adhesion between the core particles to each other, in the coarse particles, is weak. On the contrary, in the functional particles, since shell particles of a grain size smaller than that of the core particle are present in the form being buried to the surface of the moderately softened core particle, the adhesion between the core particle and the shell particle is stronger than the adhesion between the core particles to each other. Accordingly, separation of the core particles occurs selectively for the coarse particles in the depressurizing step. The depressurizing step can also be said as a grain size control step. Further, the cooling step can be said, for example, also as a step of preventing secondary aggregation between the functional particles to each other. By conducting the aggregating step, the depressurizing step, and the cooling step repetitively, the uniformity of the shape is further enhanced, the width of the grain size distribution is further narrowed, and also the property is made further uniform in the obtained functional particles while keeping the moderately reduced diameter as it is.

Further, in the invention, it is preferable that the shell particle is a resin particle, and the heating temperature A of the mixed slurry containing the core particles and the shell particles in the coiled pipeline satisfies the following relation:

$$Tg(c)<A<Tg(s)<Mp(c) \quad (1)$$

(where Tg(c) represents a glass transition temperature of a core particle, Tg(s) shows a glass transition temperature of a shell particle, and Mp(c) represents the melting point of the core particle).

According to the invention, in a case where the shell particle is a resin particle, since only the core particles are softened selectively but the shell particles are not softened to such an extent as causing deposition, by controlling the heating temperature A for the mixed slurry in the coiled pipeline during the aggregating step so as to satisfy the relation (1) described above, aggregation between the shell particles to each other can be prevented and the yield of the functional particles can be improved further.

Further, in the invention, it is preferable that the shell particle is a resin particle, and the core particles and the shell particles satisfy the following relation:

$$Tg(s)-Tg(c)\geqq 15(^\circ\,\mathrm{C.}) \quad (2)$$

(where Tg(c) and Tg(s) are identical as those described above).

According to the invention, in a case where the shell particle is a resin particle, the core particle and the shell particle preferably satisfy the relation (2) described above. Then, the particle shape of the functional particle is maintained as it is and the property of the functional particle less fluctuates even in a case where the matrix resin of the core particle is a synthetic resin of low glass transition temperature or softening temperature. Further, also the deposition between the functional particles to each other does not occur.

Further, in the invention, it is preferable that the inorganic particle is a less water insoluble inorganic particle.

Further, in the invention, it is preferable that the less water soluble inorganic particle is one or more members selected from less water soluble alkali metal salts.

According to the invention, in a case where the shell particle is an inorganic particle, a less water soluble inorganic particle is used preferably for the inorganic particle and it is particularly preferred to use a less water soluble alkali metal salt such as calcium carbonate or calcium phosphate. Since the less water soluble inorganic particle is scarcely dissolved in water, the shell particle can be deposited efficiently and reliably to the surface of the core particle even in a case of dispersing the core particle and the shell particle in an aqueous medium. Further, since water, aqueous slurry, etc. can be used as the medium for the mixed slurry, operational safety is high and the liquid waste treatment after the manufacture of the functional particles is also easy.

Further, in the invention, it is preferable that a volume average grain size of the core particle is in a range of from 3.0 to 6.0 μm and a volume average grain size of the shell particle is in a range of from 0.01 to 1.0 μm.

According to the invention, the coverage with the shell particle on the surface of the core particle is improved by using a core particle with the volume average grain size of the range of from 3.0 to 6.0 μm and a shell particles with the volume average particle size of the range of from 0.01 to 1.0 μm. As a result, a coating layer uniform in the thickness, dense, favorable in the mechanical strength, and excellent in the shape retainability is formed on the surface of the core particle.

Further, in the invention, it is preferable that the core particle contains a colorant and a release agent together with a synthetic resin.

According to the invention, the core particle preferably contains a colorant and a release agent in a synthetic resin as a matrix. More specifically, it is preferred that a colorant particle and a relating agent particle with a grain size further smaller than that of the core particle are uniformly dispersed in the synthetic resin as a matrix. The functional particle containing the core particle is colored to a desired color and softened at a relatively low temperature of about 100° C. to provide a moderate deformability. Accordingly, when the functional particle is used, for example, as a filler for a coating material, close adhesion between the coated surface and the coating film, the mechanical strength of the coating film, etc. are improved and a subtle color tone is provided to the surface of the coating film. Accordingly, by the use of the coating material containing the functional particle according to the invention, a coated product showing aesthetic appearance, with less peeling and damaging of the coating film and with high commercial value can be obtained.

Further, the invention provides a functional particle manufactured by one of the manufacturing methods described above.

According to the invention, a functional particle manufactured by the manufacturing method of the invention is provided. The functional particle of the invention is an encapsulated particle uniform in the shape, moderately reduced in the particle diameter, with narrow width for the particle grain size distribution, and with less fluctuation in the property. Further, the functional particle of the invention has an appropriate shape retainability, retains the shape under the absence of stress, and causes no fluctuation in the property along with the change of the shape. That is, during storage, the design property just after manufacture is maintained as it is. On the contrary, since the particle changes into a desired shape while showing the designed property sufficiently under a moderate stress, this is applicable to various application uses.

Further, in the invention, it is preferable that the functional particle is used as a toner for developing electrostatic latent images in an electrophotographic image forming apparatus.

According to the invention, the functional particle of the invention can be used as a toner for developing electrostatic latent images in an electrophotographic image forming apparatus. Since the functional particle of the invention is uniform in the shape, extremely narrow in the width for the grain size distribution and uniform in the charging performance, the particle can be deposited uniformly to electrostatic latent images to form toner images. Further, since the particle is moderately reduced in the grain size, it can form images that reproduce images of an original at a high fineness. Further, in a case of dispersing a colorant and a release agent in the core particle and forming a coating layer comprising shell particles on the surface thereof, even when the colorant is exposed to the surface of the core particle, it is concealed by the coating layer. Further, even when the release agent bleeds-out to the surface of the core particle, further bleed-out is suppressed by the coating layer. Accordingly, a toner with no fluctuation the charging performance, with scarce occurrence of blocking, filming, and off-set, stabile for the charging performance, and also excellent in the retainability or storability can be obtained. Further, even in a case of using a synthetic resin with a relatively low glass transition temperature for the matrix resin of the core particle and the synthetic resin is softened, since the coating layer is present, core particles are not deposited to each other. Accordingly, a toner excellent in the low temperature fixing property can be obtained easily. Further, the ingredient composition is scarcely changed for individual functional particles. Also in view of the above, the functional particle of the invention is uniform in the charging performance. By using the functional particle of the invention having such preferred property, images at high quality having high image density and excellent in the image quality and the image reproducibility can be formed stably.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
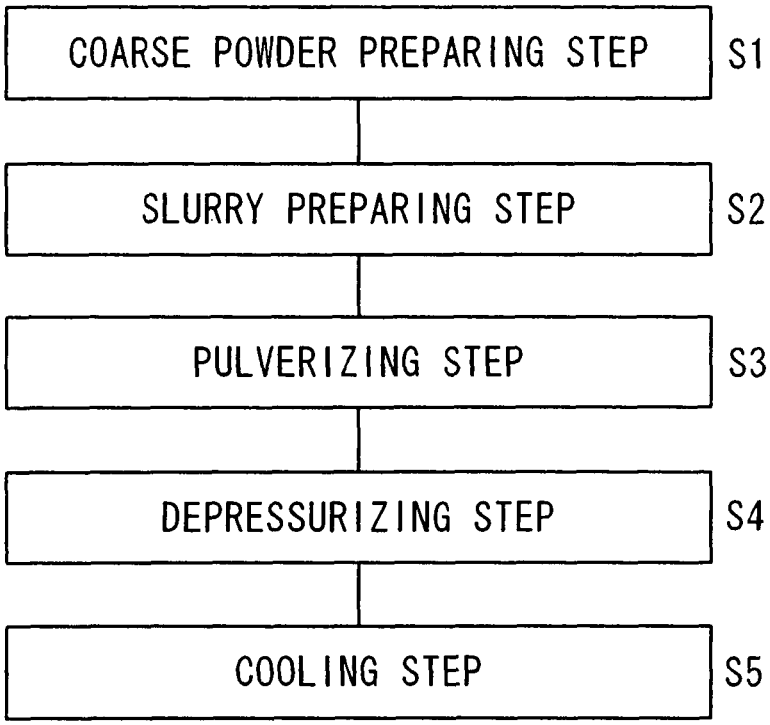
FIG. 1 is a flow chart schematically showing a manufacturing method of a core particle.

Now referring to the drawings, preferred embodiments of the invention are described below.

The functional particle of the invention is an encapsulated participle comprising a core particle as a resin particle, and a coating layer formed on the surface of the core particle. The functional particle is manufactured under grain size control preferably such that the volume average grain size falls in a range of from 5 to 6 μm. The functional particle with a volume average grain size of the range of from 5 to 6 μm, when used, for example, as a toner is excellent in the store stability under heating in a developing tank and can stably form high quality images which are at high density and high fineness, and favorable in the image reproducibility, and have no image defects. The coating layer formed on the surface of the functional particle contains shell particles with the volume average grain size smaller than that of the core particle. While the thickness of the coating layer is not particularly restricted, it is preferably in a range of from 0.1 to 1.0 μm. In a case where the thickness of the coating layer is less than 0.1 μm, occurrence of blocking cannot possibly be suppressed sufficiently, for example, in a case of using the functional particle as a toner for electrophotographic image formation. Further, in case where the thickness of the coating layer exceeds 1.0 μm, the deformability upon undergoing heating may possibly be lowered. Further, in a case of use as the toner, sufficient low temperature fixing property cannot be possibly obtained even by the use of a resin capable of low temperature fixing for the core particle.

(Core Particle)

The core particle is a resin particle having a volume average grain size preferably from 3.0 to 6.0 μm and, more preferably, from 4.0 to 5.0 μm. In a case where the volume average grain size of the core particle is less than 3.0 μm, the range for the selection of the shell particles is narrowed. Further, in a case of using a shell particle having a volume average grain size smaller than that of the volume average grain size described above, scattering of the shell particles in air tends to occur during manufacture, slurrification is laborious and the viscosity of the slurry increases to lower the operation efficiency. In a case where the volume average grain size of the core particle exceeds 6.0 μm, the grain size of the obtained function particle is excessively large to restrict the range for the application use of the functional particle.

The core particle is, preferably, a granulation product of a synthetic resin. The synthetic resin is not particularly restricted so long as the resin can be granulated in a molten state and includes, for example, polyvinyl chloride, polyvinyl acetate, polyethylene, polypropylene, polyester, polyamide, styrene polymer, (meth)acrylic resin, polyvinyl butyral, silicone resin, polyurethane, epoxy resin, phenol resin, xylene resin, rosin modified resin, terpene resin, aliphatic hydrocarbon resin, cycloaliphatic hydrocarbon resin, and aromatic petroleum resin. The synthetic resins may be used each alone, or two or more of them may be used in combination. Among them, polyester, styrene polymer, (meth)acrylate polymer, polyurethane, epoxy resin, etc. capable of easily obtaining particles having high surface smoothness by wet granulation in an aqueous system are preferred.

Known polyesters can be used and they include, for example, polycondensates of polybasic acids and polyhydric alcohols. For the polybasic acid, those known as monomers for polyesters can be used and they include, for example, aromatic carboxylic acids such as terephthalic acid, isophthalic acid, phthalic acid anhydride, trimellitic acid anhydride, pyromellitic acid, and naphthalene dicarboxylic acid, aliphatic carboxylic acids such as maleic acid anhydride, fumaric acid, succinic acid, alkenyl succinic acid anhydride, and adipic acid, methyl esterification products of such polybasic acids, etc. The polybasic acids may be used each alone, or two or more of them may be used in combination. Also for polyhydric alcohols, those known as monomers for polyesters can be used and they include, for example, aliphatic polyhydric alcohols such as ethylene glycol, propylene glycol, butanediol, hexane diol, neopentyl glycol, and glycerin, cycloaliphatic polyhydric alcohols such as cyclohexane diol, cyclohexane dimethanol, and hydrogenated bisphenol A, and aromatic diols such as ethylene oxide adduct of bisphenol A, and propylene oxide adduct of bisphenol A. The polyhydric alcohols may be used each alone, or two or more of them may be used in combination. The polycondensation reaction between the polybasic acid and the polyhydric alcohol can be conducted in accordance with a customary method and conducted, for example, by bringing the polybasic acid and the polyhydric alcohol into contact under the presence or absence of an organic solvent and the presence of a polycondensation catalyst and the reaction is completed when the acid value, the softening value, etc. of the formed polyester reach predetermined values. Thus, a polyester can be obtained. In a case of using a methyl esterification product of a polybasic acid to a portion of the polybasic acid, demethanol polycondensation reaction is conducted. In the polycondensation reaction, by properly changing the blending ratio, the reaction rate of the polybasic acid and the polyhydric alcohol, etc., the carboxylic group content at the terminal end of the polyester can be controlled and thus the property of the obtained polyester can be modified, for example. Further, in the use of trimellitic acid anhydride as the polybasic acid, a modified polyester is obtained also by introduction of carboxylic groups in the main chain of the polyester. A polyester self-dispersible in water formed by bonding a hydrophilic group such as a carboxylic group or sulfonate group to the main chain and/or side chain of the polyester can also be used.

The styrene polymer includes homopolymers of styrenic monomers, and copolymers of a styrenic monomer and a monomer copolymerizable with the styrenic monomer. The styrenic monomer includes, for example, styrene, o-methylstyrene, ethylstyrene, p-methoxystyrene, p-phenylstyrene, 2,4-dimethylstyrene, p-n-octylstyrene, p-n-decylstyrene, p-n-dodecylstyrene and the like. Other monomers include, for example, (meth)acrylic esters such as methyl(meth)acrylate, ethyl(meth)acrylate, propyl(meth)acrylate, butyl(meth) acrylate, isobutyl(meth)acrylate, n-octyl(meth)acrylate, dodecyl(meth)acrylate, 2-ethylhexyl(meth)acrylate, stearyl (meth)acrylate, phenyl(meth)acrylate, and dimethylaminoethyl(meth)acrylate, (meth)acrylic monomers such as acrylonitrile, methacrylamide, glycidyl methacrylate, N-methylolacrylamide, N-methylolmethacrylamide, and 2-hydroxyethylacrylate, vinyl ethers such as vinyl methyl ether, vinyl ethyl ether, and vinylisobutyl ether, vinyl ketones such as vinyl methyl ketone, vinyl hexyl ketone, and methylisopropenyl ketone, and N-vinyl compounds such as N-vinyl pyrrolidone, N-vinyl carbazole, and N-vinyl indole. The styrenic monomers and the monomers copolymerizable with the styrenic monomers can be used each alone, or two or more of them may be used.

The (meth)acrylic resins include, for example, homopolymers of (meth)acrylate esters, copolymers of (meth)acrylate esters and monomers copolymerizable with the (meth)acrylate esters. For the (meth)acrylate esters, those esters identical with those described previously can be used. The monomers copolymerizable with the (meth)acrylate esters include, for example, (meth)acrylic monomers, vinyl ethers, vinyl ketones, and N-vinyl compounds. Those monomers identical with those described above can be used. As the (meth)acrylic resin, acidic group-containing acrylic resins can also be used. The acidic group-containing acrylic resin can be prepared, for example, by using an acrylic resin monomer containing an acidic group or a hydrophilic group and/or a vinylic monomer having an acrylic group or a hydrophilic group together upon polymerization of the acrylic resin monomer or the acrylic resin monomer and the vinylic monomer. Known monomers can be used as the acrylic resin monomer and include, for example, acrylic acid which may have a substituent, a methacrylic acid which may have a substituent, an acrylic ester which may have a substituent, and a methacrylate ester which may have a substituent. The acrylic resin monomers may be used each alone, or two or more of them may be used in combination. Also for vinylic monomers known monomers can be used and include, for example, styrene, α-methylstyrene, vinyl bromide, vinyl chloride, vinyl acetate, acrylonitrile, and methacrylonitrile. The vinylic monomers may be used each alone, or two or more of them may be used in combination. Polymerization for the styrenic polymer and (meth)acrylic resin is conducted by solution polymerization, suspension polymerization, emulsification polymerization, etc. by using a usual radical initiator.

The polyurethane is not particularly restricted and, for example, acidic group or basic group-containing polyurethanes can be used preferably. The acidic group or the basic group-containing polyurethane can be prepared in accordance with the known method. For example, the acidic group or basic group-containing diol, polyol, and polyisocyanate may be subjected to addition polymerization. The acid group or basic group-containing diol includes, for example, dimethylol propionic acid and N-methyldiethanol amine. The polyol includes, for example, polyester polyol such as polyethylene glycol, polyester polyol, acryl polyol, and polybutadiene polyol. The polyisocyanate includes, for example, tolylene diisocyanate, hexamethylene diisocyanate, and isophorone diisocyanate. The ingredients may be used each alone, or two more of them may be used in combination. The epoxy resin is not particularly restricted, and an acidic group or basic group-containing epoxy resin can be used preferably. The acid group or basic group-containing epoxy resin can be prepared, for example, by addition or addition polymerization of a polybasic carboxylic acid such as adipic acid and trimellitic acid anhydride or amine such as dibutylamine or ethylene diamine, to an epoxy resin as a base.

In a case of using the finally obtained functional particle as a toner for use in an electrophotographic image formation, polyester is preferred among the synthetic resins described above. Since the polyester is excellent in the transparency and can provide the functional particle with good powder fluidity, low temperature fixing property, and secondary color reproducibility, etc., it is suitable as a binder resin for color toner. Further, the polyester and the acrylic resin may also be grafted and used. Further, among the synthetic resins described above, a synthetic resin with a softening temperature of 150° C. or lower is preferred and a synthetic resin with a softening temperature of from 60 to 150° C. is particularly preferred while considering easy practice of the granulation operation to the core particle, kneading property of the additive with the synthetic resin, and more uniform shape and the size of the core particle. Further, among them, a synthetic resin with a weight average molecular weight of 5,000 to 500,000 is preferred. The synthetic resins can be used each alone, or two or more of different resins may be used in combination. Further, even identical resins, those different in one or all of the molecular weight, the monomer composition, etc. can be used in plurality.

In the invention, a self-dispersible resin may be used as the synthetic resin. The self-dispersible resin is a resin having a hydrophilic group in the molecule and having dispersibility to liquid such as water. The hydrophilic group includes, for example, —COO— group, —$SO_3$— group, —CO group, —OH group, —$OSO_3$— group, —$PO_3H_2$ group, —$PO_4$-group, and salts thereof. Among them, anionic hydrophilic group such as —COO-group, and —$SO_3$— group are particularly preferred. The self-dispersible resin having one or more of such hydrophilic groups is dispersed in water without using a dispersant or by using an extremely small amount of the dispersant. While the amount of the hydrophilic group contained in the self-dispersing resin is not particularly restricted, it is preferably in a range of from 0.001 to 0.050 mol and, more preferably, from 0.005 to 0.030 mol based on 100 g of the self-dispersible resin. The self-dispersible resin can be prepared, for example, by bonding a compound having a hydrophilic group and an unsaturated double bond (hereinafter referred to as "hydrophilic group-containing compound" to the resin. Bonding of the hydrophilic group-containing compound to the resin can be conducted in accordance with a method such as graft polymerization or block polymerization. Further, the self-dispersible resin can be prepared also by polymerizing a hydrophilic group-containing compound or a hydrophilic group-containing compound and a compound copolymerizable therewith.

The resin to which the hydrophilic group-containing compound is bonded includes, for example, styrenic resins such as polystyrene, poly-α-methylstyrene, chloropolystyrene, styrene-chlorostyrene copolymer, styrene-propylene copolymer, styrene-butadiene copolymer, styrene-vinyl chloride copolymer, styrene-vinyl acetate copolymer, styrene maleic acid copolymer, styrene-acrylate ester copolymer, styrene-methacrylate ester copolymer, styrene-acrylate ester-methacrylate ester copolymer, styrene-α-methylchloroacrylate copolymer, styrene-acrylonitrile-acrylate ester copolymer, and styrene-vinylmethyl ether copolymer, (meth)acrylic resin, polycarbonate, polyester, polyethylene, polypropylene, polyvinyl chloride, epoxy resin, urethane-modified epoxy resin, silicone-modified epoxy resin, rosin-modified maleic resin, ionomer resin, polyurethane, silicone resin, ketone resin, ethylene-ethylacrylate copolymer, xylene resin, polyvinyl butylal, terpene resin, phenole resin, aliphatic hydrocarbon resin, and cycloaliphatic hydrocarbon resin.

The hydrophilic group-containing compound includes, for example, unsaturated carboxylic acid compounds, and unsaturated sulfonic acid compounds. The unsaturated carboxylic acid compounds include, for example, unsaturated carboxylic acids such as (meth)acrylic acid, crotonic acid, and isocrotonic acid, unsaturated dicarboxylic acids such as maleic acid, fumalic acid, tetrahydrophthalic acid, itaconic acid, and citraconic acid, acid anhydrides such as maleic acid anhydride, and citraconic acid anhydride and alkyl esters, dialkyl esters, alkali metal salts, alkaline earth metal salts, and ammonium salts thereof. As the unsaturated sulfonic acid compounds, styrene sulfonic acids, sulfoalkyl (meth)acrylates, metal salts, ammonium salts thereof, etc. can be used. The hydrophilic group-containing compounds may be used each alone, or two or more of them may be used in combination. Further, as monomer compounds other than the hydrophilic-containing compounds, sulfonic acid compounds, etc. can be used. The sulfonic acid compounds include, for example, sulfoisophthalic acid, sulfoterephthalic acid, sulfophthalic acid, sulfosuccinic acid, sulfobenzoic acid, sulfosalicylic acid, and metal salts and ammonium salts thereof.

The synthetic resin used in the invention may contain one or more of general additives for use in synthetic resins. Specific examples of the additives for use in the synthetic resins include, for example, various shapes (granular, fibrous, flaky shapes) of inorganic fillers, colorants, antioxidants, release agents, antistatics, charge controllers, lubricants, heat stabilizers, flame retardants, anti-dripping agents, UV-absorbents, light stabilizers, light screening agents, metal inactivating agents, antiaging agents, lubricants, plasticizers, impact improvers, and solubilizing agents.

In a case of using the finally obtained functional particle as the toner, a colorant, a release agent, a charge controller, etc. are preferably incorporated in the synthetic resin. The colorant is not particularly restricted and, for example, organic dyes, organic pigments, inorganic dyes, and inorganic pigments can be used. The black colorant includes, for example, carbon black, copper oxide, manganese dioxide, aniline black, activated carbon, non-magnetic ferrite, magnetic ferrite, and magnetite.

Yellow colorant includes, for example, chrome yellow, zinc yellow, cadmium yellow, yellow iron oxide, mineral fast yellow, nickel titanium yellow, nable yellow, naphthol yellow S, hanza yellow G, hanza yellow 10G, benzidine yellow G, benzidine yellow GR, quinoline yellow lake, permanent yellow NCG, tartrazine lake, C.I.pigment yellow 12, C.I.pigment yellow 13, C.I.pigment yellow 14, C.I.pigment yellow 15, C.I.pigment yellow 17, C.I.pigment yellow 93, C.I.pigment yellow 94, and C.I.pigment yellow 138.

The orange colorant includes, for example, red chrome yellow, molybdenum orange, permanent orange GTR, pyrazolone orange, Vulcan orange, Indathrene brilliant orange RK, benzidine orange G, Indanthrene brilliant orange GK, C.I.pigment orange 31, and C.I.pigment orange 43.

The red colorant includes, for example, red iron oxide, cadmium red, Indian red, mercury sulfide, cadmium, permanent red 4R, resol red, pyrazolon red, watching red, calcium salt, lake red C, lake red D, brilliant carmine 6B, eosine lake, rhodamine lake B, alizarin lake, brilliant carmine 3B, C.I.pigment red 2, C.I.pigment red 3, C.I.pigment red 5, C.I.pigment red 6, C.I.pigment red 7, C.I.pigment red 15, C.I.pigment red 16, C.I.pigment red 48:1, C.I.pigment red 53:1, C.I.pigment red 57:1, C.I.pigment red 122, C.I.pigment red 123, C.I.pigment red 139, C.I.pigment red 144, C.I.pigment red 149, C.I.pigment red 166, C.I.pigment red 177, and C.I.pigment red 178, and C.I.pigment red 222.

The purple colorant includes, for example, manganese purple, fast violet B, and methyl violet lake. The blue colorant includes, for example, Prussian blue, cobalt blue, alkali blue lake, Victoria blue lake, phthalocyanine blue, non-metal phthalocyanine blue, partially chlorinated phthalocyanine blue, fast sky blue, Indanthrene blue BC, C.I.pigment blue 15, C.I.pigment blue 15:2, C.I.pigment blue 15:3, C.I.pigment blue 16, and C.I.pigment blue 60.

The green colorant includes, for example, chrome green, chrome oxide, pigment green B, malachite green lake, final yellow green G and C.I.pigment green 7. White colorant includes, for example, compounds such as zinc powder, titanium oxide, antimony white, and zinc sulfide. The colorants may be used each alone, or two or more of them of different colors may be used in combination. Further, those of identical colors may also be used by two or more in combination. While the content of the colorant in the core particle is not particularly restricted, it is preferably in a range of from 0.1 to 20% by weight, and, more preferably, from 0.2 to 10% by weight based on the entire amount of the core particles.

Also the release agent is not particularly restricted and includes, for example, petroleum type waxes such as paraffin wax and derivatives thereof and microcrystalline wax and derivatives thereof, hydrocarbon type synthesis waxes such as Fischer-Tropsch wax and derivatives thereof, polyolefin wax and derivatives thereof, low molecular weight polypropylene wax and derivatives thereof, and polyolefinic polymer wax (low molecular weight polyethylene wax, etc.) and derivatives thereof, plant type waxes such as carnauba wax and derivatives thereof, rice wax and derivatives thereof, candellila wax and derivatives thereof, and Japanese wax, animal type waxes such as bees wax and whale wax, oil and fat type synthesis waxes such as aliphatic acid amide and phenol aliphatic acid ester, long chained carboxylic acids derivatives thereof, long chain alcohols and derivatives thereof, silicone type polymers, and higher fatty acids. The derivatives include oxides, block copolymers of vinylic monomer and wax, and grafted modification product of vinylic monomer and wax. Among them, waxes having melting point higher than the liquid temperature of an aqueous solution of a water soluble dispersant in the granulation step are preferred. The content of the release agent in the core particle is not particularly restricted and selected properly from a wide range and it is preferably from 0.2 to 20% by weight based on the entire amount of the core particle.

Also the charge controllers are not restricted particularly and those for positive charge control and negative charge control can be used. The charge controller for positive charge control includes, for example, basic dye, quaternary ammonium salt, quaternary phosphonium salt, aminopyrine, pyrimidine compound, polynuclear polyamide compound, aminosilane, nigrosine dye and derivatives thereof, triphenyl methane derivatives, guanidine salts, and amidine salts. The charge controller for negative charge control includes oil soluble dyes such as oil black and spilon black, metal containing azo-compounds, azo-complex dyes, metal naphthenate salts, metal complexes and metal salts of salicylic acid and derivatives thereof (metal: chromium, zinc, zirconium, etc.), fatty acid soap, long chained alkyl carboxylate salts, and resinic acid soaps. The charge controllers can be used each alone or optionally by two or more of them in combination. The content of the charge controller in the core particle is not particularly restricted and can be selected properly from a wide range and it is preferably from 0.5 to 3% by weight based on the entire amount of the core particle.

In a case of using the functional particle of the invention as a toner in an electrophotographic system, a surface modification may be applied to the functional particle by using an external additive. As the external additives, those used customarily in the field of electronic photography can be used and include, for example, silica, titanium oxide, silicone resin, silica surface treated with a silane coupling agent, and titanium oxide. The amount of the external additive to be used is, for example, from 1 to 10 parts by weight based on 100 parts by weight of the functional particles.

In a case of using the functional particle of the invention as the toner in the electrophotographic system, it may be either in the form of one-component developer or two-component developer. In the case of use as the one-component developer, only the functional particle is used without using a carrier and the functional particles are deposited on a sleeve by being triboelectrically charged in a development sleeve using a blade and a fur brush and conveyed to form images. In a case of use as the two-component developer, the functional particle and the carrier are used in combination. Those carriers used customarily in the field of electronic photography can be used as the carrier and they include, for example, ferrite containing one or more of materials selected from iron, copper, zinc, nickel, cobalt, manganese, and chromium. A coating layer may also be formed on the surface of the carrier. The material for the coating material includes, for example, polytetrafluoroethylene, monochlorotrifluoroethylene polymer, polyvinylidene fluoride, silicone resin, polyester, di-tert-butyl salicylate metal salt, styrenic resin, acrylic resin, polyacid, polyvinyl butyral, nigrosine, aminoacrylate resin, basic dye, laked basic dye, silica powder, and alumina powder. The material for the coating layer is selected properly in accordance with the ingredients contained in the functional particle. Materials for the coating layer may be used each alone or two or more of them in combination. The average grain size of the carrier is, preferably, in a range of from 10 to 100 μm and, more preferably, from 20 to 50 μm.

(Preparation Method of Core Particle)

While the core particle can be prepared by either the pulverization method or the wet method, the wet method is preferred considering the shape of the core particle per se and the uniformity of the grain size. A known method can be utilized for the wet method and includes, for example, a suspension polymerization method, phase inversion emulsification method, melt emulsification method, emulsification dispersion method, and high pressure homogenizer method. According to the suspension polymerization method, a monomer of a synthetic resin is dispersed in an organic solvent under the presence of an organic suspension stabilizer and the synthetic resin monomer is polymerized to obtain a core particle. According to the phase inversion emulsification method, a naturalizing agent for neutralizing the dissociation group of the water dispersible resin and water are added under stirring to an organic solvent solution of the water dispersible resin to form resin droplets which is then put to phase inversion emulsification to obtain a core particle. According to the melt emulsification method, a core particle is obtained by mixing under heating a molten kneaded product of a synthetic resin and an aqueous solution of a water soluble dispersant. According to the emulsification dispersion method, a core particle is obtained by dispersing and emulsifying an organic solvent solution of a synthetic resin in an aqueous medium containing a dispersion stabilizer such as calcium phosphate or calcium carbonate and then removing the organic solvent. According to the high pressure homogenizer method, a core particle is obtained by pulverizing a synthetic resin under pressure by a high pressure homogenizer. Among the methods described above, a high pressure homogenizer method is preferred considering the uniformity of the shape and the grain size. As a high pressure homogenizer used in the high pressure homogenizer method, commercial products, those described in patent documents, etc. have been known. The commercial products of the high pressure homogenizer include, for example, chamber type high-pressure homogenizer such as microfluidizer (trade name of products manufactured by Microfluidics Corp.), nanomizer (trade name of products manufactured by Nanomizer Co.), Ultimizer (trade name of products manufactured by Sugino Machine Ltd.), high pressure homogenizer (trade name of products manufactured by Rannie Co.), high pressure homogenizer (trade name of products manufactured by Sanmaru Machinery Co. Ltd.), and high pressure homogenizer (trade name of products manufactured by Izumi Food Machinery Co.). Further, high pressure homogenizers described in the patent documents include, for example, those described in International Publication WO 03/059497. Among them, the high pressure homogenizer described in WO 03/059497 is preferred.

Figure 2:
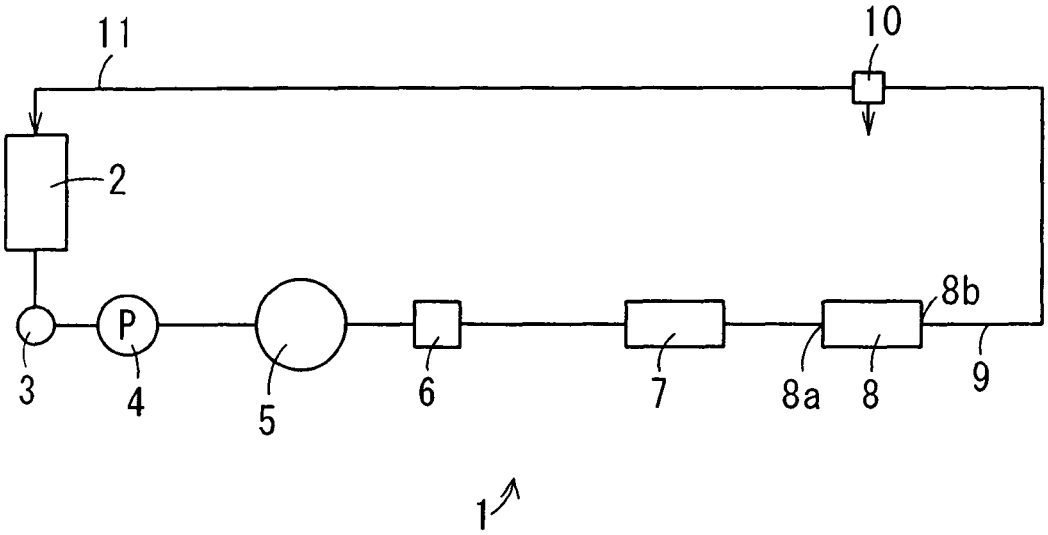
FIG. 2 is a system chart showing a simplified constitution of a high pressure homogenizer.

FIG. 1 shows an example of a manufacturing method of core particles using the high pressure homogenizer described in WO 03/059497. FIG. 1 is a flow chart schematically showing the manufacturing method of the core particle. The manufacturing method shown in FIG. 1 includes a coarse powder preparing step S1, a slurry preparing step S2, a pulverizing step S3, a depressurizing step S4, and cooling step S5. Among the steps, the pulverizing step S3, the depressurizing step S4, and the cooling step S5 are conducted, for example, by using a high pressure homogenizer 1 shown in FIG. 2. FIG. 2 is a system chart showing a simplified constitution of a high pressure homogenizer 1. The high pressure homogenizer 1 includes a tank 2, a delivery pump 3, a pressurizing unit 4, a heater 5, a pulverizing nozzle 6, a depressurizing module 7, a cooler 8, a pipeline 9, and a dispensing port 10. In the high pressure homogenizer 1, the tank 2, the delivery pump 3, the pressurizing unit 4, the heater 5, the pulverizing nozzle 6, the depressurizing module 7, and the cooler 8 are connected in this order by way of the pipeline 9. In the system connected by the pipeline 9, the mixed slurry after being cooled by the cooler 8 may be taken out of the system from the dispensing port 10, or the mixed slurry after being cooled by the cooler 8 may be returned again to the tank 2 and circulated repetitively in the direction of an arrow 11. The process till the coarse powder slurry passes the pulverizing nozzle 6 is a pulverizing step S3 and the step of passing the depressurizing module 7 is the depressurizing step S4 and the step of passing the cooler 8 is a cooling step S5.

The tank 2 is a vessel-like member having an inner space which stores a coarse powdery slurry obtained in the slurry preparing step S2. The delivery pump 3 delivers the coarse powder slurry stored in the tank 2 to the pressurizing unit 4. The pressurizing unit 4 pressurizes the coarse powdery slurry supplied from the deliver pump 3 and delivers the slurry to the heater 5. The pressurizing unit 4 can use a plunger pump including, for example, a plunger and a pump driven for suction and discharge by the plunger. The heater 5 heats the coarse powder slurry in a pressurized state supplied from the pressurizing unit 4. For the heater 5, those including a not illustrated coiled (or helical) pipeline and a not illustrated heating portion can be used. The coiled pipeline has a not illustrated flow channel at the inside thereof, in which a pipe-like member for allowing a coarse powdery slurry to flow therethrough is wound into a coiled shape (or helical shape). The heating portion is disposed along the outer circumferential surface of the coiled pipeline and includes a pipeline through which steams, heat medium, etc. can flow, and a heating medium supply portion for supplying steams and a heat medium to the pipeline. The heating medium supply portion is, for example, a boiler. When an aqueous slurry containing particles is allowed to flow through the coiled pipeline in the heater 5, centrifugal force and shearing force are provided in a heated and pressurized state. Since the centrifugal force and the shearing force act simultaneously, a turbulence flow is generated in the flow channel. In a case where the particle is a sufficiently small particle as a core particle with a volume average grain size of from 0.4 to 3 μm, particles flow irregularly under the effect of the turbulence flow in which frequency of collision between particles to each other increases remarkably to cause aggregation. On the other hand, in a case where the particle is a coarse powder with a grain size of about 100 μm, since the particle is large enough, the particles flow in a stable state near the inner wall surface of the flow channel by the centrifugal force and since they less undergo the effect of the turbulence flow, aggregation less occurs.

Figure 3:
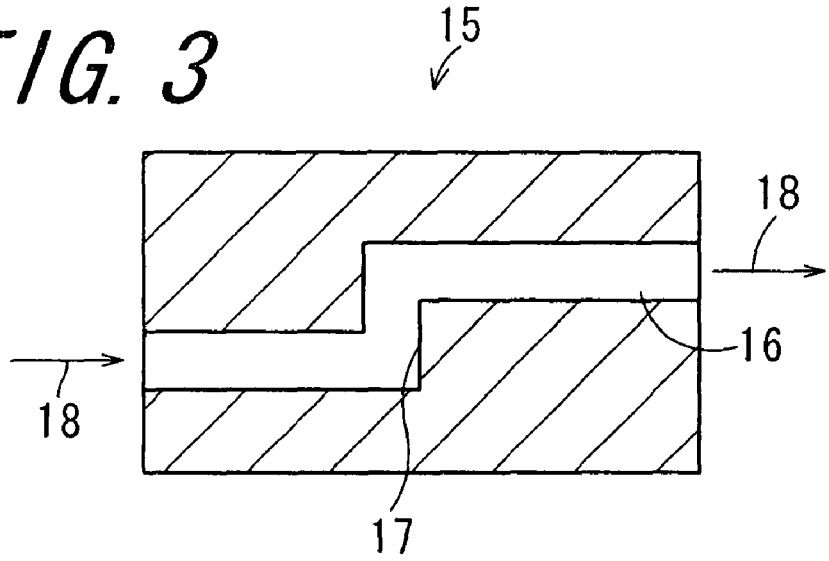
FIG. 3 is a cross sectional view schematically showing a constitution of a pressure proof nozzle.

The pulverizing nozzle 6 pulverizes a coarse powder in a heated and pressurized state supplied from the heater 5 into core particles by flowing the coarse powder slurry through the flow channel formed to the inside thereof. While a general pressure proof nozzle capable of passing the fluid can be used for the pulverizing nozzle 6, a multiple nozzle having a plurality of flow channels can be used preferably for example. The flow channels of the multiple nozzle may be formed on coaxial circles with the axis of the multiple nozzle as the center, or a plurality of flow channels may be formed substantially in parallel in the longitudinal direction of the multiple nozzle. A specific example of the multiple nozzle includes those having flow channels having an inlet diameter and an outlet diameter of about 0.05 to 0.35 mm, and a length of about 0.5 to 5 cm formed by one or in plurality, preferably, about from 1 to 2. Further, a pressure proof nozzle in which the flow channel is not formed linearly in the inside of the nozzle can also be used. Such a pressure-proof nozzle can include those, for example, as shown in FIG. 3. FIG. 3 is a cross sectional view schematically showing the constitution of a pressure proof nozzle 15. The pressure proof nozzle 15 has a flow channel 16 in the inside thereof. The flow channel 16 is flexed in a hook-like manner and has at least one collision wall 17 against which a coarse powder slurry intruding into the flow channel 16 in the direction of an arrow 18 collides. The coarse powder slurry collides against the collision wall 17 substantially at a normal angle, by which the coarse powder is pulverized into a core particle of a further reduced diameter and discharged from the exit of the pressure proof nozzle 15. In the pressure proof nozzle 15, while the inlet diameter and the exit diameter are formed in an identical size, but they are not restricted thereto and the diameter for the exit may be formed smaller than that for the inlet. The exit and the inlet are usually formed in a normal circular shape but they are not restricted thereto, and may be formed, for example, into a normal polygonal shape or the like. The pressure proof nozzle may be disposed in one or disposed by plurality.

For the depressurizing module 7, a multi-stage depressurizing device described in WO 03/059497 is used preferably. The multi-stage depressurizing device includes an inlet channel, an exit channel, and a multi-stage depressurizing channel. The inlet channel is connected at one end to the pipeline 9 and connected at the other end to the multi-stage depressurizing channel and introduces a slurry containing core particles in a heated and pressurized state into the multi-stage depressurizing channel. The multi-stage depressurizing channel is connected at one end to the inlet channel and connected at the other end to the exit channel, and depressurizes the slurry in the heated and pressurized state introduced to the inside by way of the inlet channel such that the generation of bubbles (bubbling) due to bumping does not occur. The multi-stage depressurizing channel includes, for example, a plurality of depressurizing members and a plurality of connection members. As the depressurizing member, a pipe-shaped member is used for example. As the connection member, a ring-shaped seal member is used for example. The multi-stage depressurizing channel is constituted by connecting a plurality of the pipe shaped members of different inner diameters by the ring-shaped seal members. For example, this includes a multi-stage depressurizing channel constituted by connecting pipe-shaped members A having an identical inner diameter by the number of 2 to 4 by the ring-shaped seal members from the inlet channel to the exit channel, connecting a next pipe-shape member B having an inner diameter larger by about twice the pipe-shaped member A by the number of one by the ring-shaped seal member and, further, connecting pipe-shaped members C having an inner diameter smaller by about 5 to 20% than the pipe-shaped member B by the number of about 1 to 3 by the ring-shaped seal members. When a slurry in the heated and pressurized state is caused to flow through the multi-stage depressurizing channel, the slurry can be depressurized to an atmospheric pressure or a depressurized to a state approximate thereto without causing bubbling. A heat exchanging portion using a cooling medium or heating medium may be disposed to the periphery of the multi-stage depressurizing channel and cooling or heating may be conducted simultaneously with depressurization in accordance with the value of the pressure applied to the slurry. The exit channel is connected at one end to the multi-stage depressurizing channel and connected at the other end to the pipeline 9, and delivers the slurry depressurized by the multi-stage depressurizing channel to the pipeline 9. The multi-stage depressurizing device may be constituted such that the inlet diameter and the exit diameter are identical or may be constituted such that the exit diameter is larger than the inlet diameter.

Figure 4:
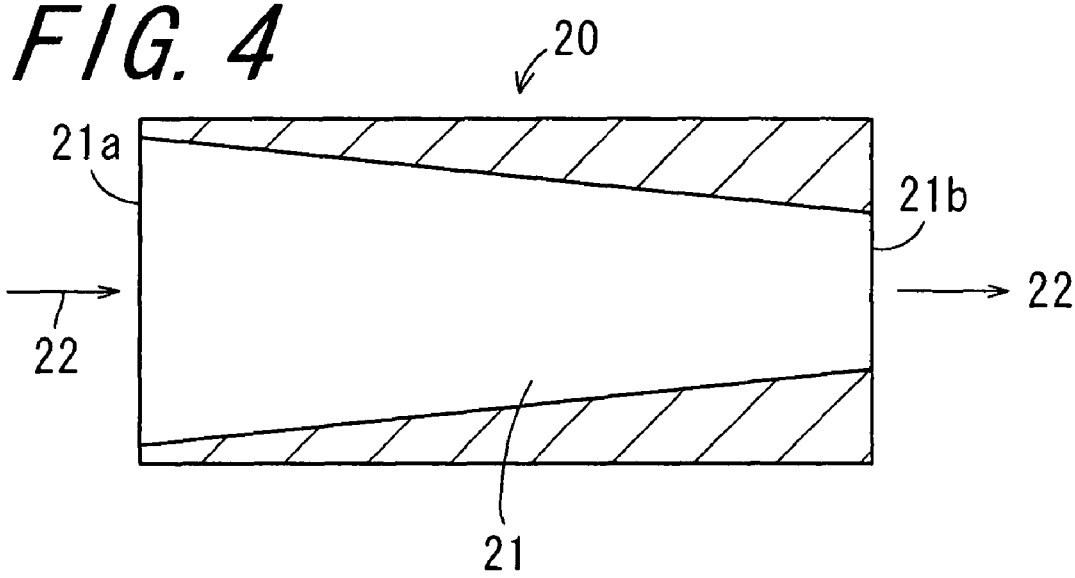
FIG. 4 is a cross sectional view schematically showing the constitution of a depressurizing nozzle.

In this embodiment, the depressurizing module 7 is not restricted to the multi-stage depressurizing device having the constitution as described above but, for example, a depressurizing nozzle can also be used. FIG. 4 is a longitudinal cross sectional view schematically showing the constitution of a depressurizing nozzle 20. In the depressurizing nozzle 20, a flow channel 21 passing through the inside in the longitudinal direction is formed. An inlet 21*a* and an exit 21*b* of the flow channel 21 are connected respectively to the pipeline 9. The flow channel 21 is formed such that the diameter of the inlet is larger than diameter of the exit. Further in this embodiment, the cross section in the direction perpendicular to the direction of an arrow 22 showing the flowing direction of the slurry is gradually decreased from the inlet 21*a* to the exit 21*b*, and the center of the cross section (axial line) is present on one identical axial line (axial line of the depressurizing nozzle 20) parallel to the direction of the arrow 22. According to the depressurizing nozzle 20, a slurry in the pressurized and heated state is introduced from the inlet 21*a* into the flow channel 21 and, after being depressurized, discharged from the exit 21*b* to the pipeline 9. The multi-stage depressurizing device or the depressurizing nozzle as described above may be disposed by the number of one or in plurality. In a case of providing the device in plurality, they may be disposed in series or parallel.

For a cooler 8, a general liquid cooler having a pressure proof structure can be used and, for example, a cooler having a pipeline for circulating cooling water disposed to the periphery of the pipeline through which the slurry flows, and cooling the slurry by circulating the cooling water can be used. Among them, a cooler having a large cooling area such as a bellows type cooler is preferred. Further, it is preferably constituted such that the cooling gradient decreases (or cooling performance is lowered) from the cooler inlet to the cooler exit. Since this can prevent re-aggregation of the pulverized core particles further, microparticulation of the coarse powder can be attained more efficiently to improve the yield of the core particles as well. The cooler 8 may be disposed by the number of one or in plurality. In a case of providing the cooler in plurality, they may be arranged serially or in parallel. In a serial arrangement, the cooler is preferably disposed such that the cooling performance is lowered gradually in the flowing direction of the slurry. The slurry containing the core particles and in the heated state discharged from the depressurizing module 7 is introduced, for example, from the inlet 8*a* connected to the pipeline 9 of the cooler 8 into the cooler 8, cooled at the inside of the cooler 8 having the cooling gradient and discharged from the exit 8*b* of the cooler 8 to the pipeline 9.

The high pressure homogenizer 1 is commercially available. Specific examples include, for example, NANO3000 (trade name of products manufactured by Beryu Co. Ltd.). According to the high pressure homogenizer 1, a slurry of coarse particles is obtained by introducing a coarse powder slurry stored in the tank 2 into the nozzle 6 for pulverization in a heated and pressurized state, pulverizing the coarse powder into core particles, introducing the slurry of the core particles in the heated and pressurized state discharged from the powderizing nozzle 6 and depressurizing the same so as not to cause bubbling, introducing the slurry of the core particles in the heated state discharged from the depressurizing module 7 into the cooler 8 and cooling the same. The slurry of the core particles is discharged from a dispensing port 10, or circulated again into the tank 2 and applied with the pulverizing treatment in the same manner.

[Coarse Powder Preparing Step S1]

In this step, a coarse powder of a synthetic resin is prepared. In this case, the synthetic resin may contain one or more of additives for the synthetic resin. The coarse powder of the synthetic resin can be prepared, for example, by pulverizing a solidification product of a kneaded product containing the synthetic resin and, optionally, one or more of additives for the synthetic resin. The kneaded product can be prepared, for example, by dry mixing the synthetic resin and, optionally, one or more of additives for the synthetic resin in a mixer and kneading the obtained powder mixture in a kneader. The kneading temperature is at or higher than the melting temperature of the binder resin (usually about 80 to 200° C., and, preferably, about 100 to 150° C.). As the mixer, known mixers can be used and include, for example, Henschel mixer type mixing derives such as Henschel mixer (trade name of products manufactured by Mitsui Mining Co. Ltd.), Supermixer (trade name of products manufactured by Kawata Manufacturing Co. Ltd.), and Mechanomill (trade name of products manufactured by Okada Seiko Co., Ltd.), and Ongumill (trade name of products manufactured by Hosokawa Micron Corp.), Hybridization system (trade name of products manufactured by Nara Machinery Co., Ltd.), and Cosmo system (trade name of products manufactured by Kawasaki Heavy Industries Ltd.). As the kneaders, known kneaders can be used and include, for example, general kneading machines such as twin roll extruders, three rolls, and laboplast mills can be used. More specifically, single screw or twin screw extruders such as TEM-100B (trade name of products manufactured by Toshiba Kikai Co.), and PCM-65/87 (trade name of products manufactured by Ikegai Ltd.), and open roll systems such as Kneadix (trade name of products manufactured by Mitsui Mining Co., Ltd.). Among them, the open roll system is preferred. Further, for uniformly dispersing the additives for the synthetic resin such as a colorant into the kneaded product, they may be used being formed as a master batch. Further, two or more kinds of additives for the synthetic resin may be formed and used as composite particles. The composite particle can be prepared, for example, by adding an appropriate amount of water or lower alcohol to two or more kinds of additives for the synthetic resin, granulating them by a usual granulating machine such as a high speed mill and then drying them. The master batch and the composite particles are mixed to the powder mixture upon dry mixing.

The solidification product is obtained by cooling the kneaded product. For the pulverization of the solidification product, a powder pulverizer such as a cutter mill, feather mill, or jet mill is used. Thus, a coarse powder of the synthetic resin is obtained. While the grain size of the coarse powder is not particularly restricted, it is preferably in a range of from 450 to 1000 μm and, more preferably, from 500 to 800 μm.

[Slurry Preparing Step S2]

In the slurry preparing step S2, a coarse powder slurry is prepared by mixing the synthetic resin coarse powder obtained in the coarse powder preparing step S1 and a liquid and dispersing the synthetic resin coarse powder in the liquid. The liquid to be mixed with the synthetic resin coarse powder is not particularly restricted so long as this is a liquid not dissolving but capable of uniformly dispersing the synthetic resin coarse powder and, in view of easy step control, liquid waste disposal after all steps and easy handlability, water is preferred and water containing a dispersion stabilizer is further preferred. The dispersion stabilizer is preferably added to water before adding the synthetic resin coarse powder to water. Those dispersion stabilizers customarily used in the relevant field can be used. Among them, water soluble polymeric dispersion stabilizers are preferred. The water soluble polymeric dispersion stabilizer includes, for example, (meth) acrylic polymers, plyoxyethylenic polymers, cellulosic polymers, polyoxyalkylene alkyl aryl ether sulfates, polyoxyalkylene alkyl ether sulfates.

(Meth)acrylic polymers include one or more hydrophilic monomers selected from acrylic monomers such as (meth) acrylic acid, α-cyano acrylic acid, α-cyano methacrylic acid, itaconic acid, crotonic acid, fumaric acid, maleic acid, and maleic acid anhydride; hydroxyl group-containing acrylic monomers such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, and 3-chloro-2-hydroxypropyl methacrylate; ester type monomers such as diethylene glycol monoacrylate ester, diethylene glycol monomethacrylate ester, glycerin monoacrylate ester, and glycerin monomethacrylate ester; vinyl alcohol monomers such as N-methylol acrylamide and N-methylol methacrylamide; vinyl alkyl etheric monomers such as vinyl methyl ether, vinyl ethyl ether, and vinyl propyl ether; vinyl alkyl esteric monomers such as vinyl acetate, vinyl propionate, and vinyl butylate; aromatic vinylic monomers such as styrene, α-methylstyrene, and vinyl toluene; amide monomers such as acrylamide, methacrylamide, diacetone acrylamide, and methylol compounds thereof; nitril monomers such as acrylonitrile and methacrylonitrile; acid chloride monomers such as acryl acid chloride and methacrylic acid chloride; nitrogen-containing vinyl heterocyclic monomers such as vinyl pyridine, vinyl pyrrolidone, vinyl imidazole, and ethylene imine; and crosslinkable monomers such as ethylene glycol dimethacrylate, diethylene glycol dimethacrylate, aryl methacrylate, and divinyl benzene.

Polyoxyethylenic polymers include, for example, polyoxyethylene, polyoxypropylene, polyoxyethylene alkylamine, polyoxypropylene alkylamine, polyoxyethylene alkylamide, polyoxypropylene alkylamide, polyoxyethylene nonylphenyl ether, polyoxypropylene laurylphenyl ether, polyoxyethylene stearylphenyl ester, and polyoxyethyene nonylphenyl ester.

Cellulosic polymers include, for example, methyl cellulose, hydroxyl ethyl cellulose, and hydroxypropyl cellulose.

Polyoxyalkylene alkylaryl ether sulfates include, for example, sodium polyoxyethylene laurylphenyl ether sulfate, potassium polyoxyethylene laurylphenyl ether sulfate, sodium polyoxyethylene nonylphenyl ether sulfate, sodium polyoxyethylene oleylphenyl ether sulfate, sodium polyoxyethylene cetylphenyl ether sulfate, ammonium polyoxyethylene laurylphenyl ether sulfate, ammonium polyoxyethylene nonylphenyl ether sulfate, and ammonium polyoxyethylene oleylphenyl ether sulfate.

Polyoxyalkylene alkyl ether sulfates include, for example, sodium polyoxyethylene lauryl ether sulfate, potassium polyoxyethylene lauryl ether sulfate, sodium polyoxyethylene oleyl ether sulfate, sodium polyoxyethylene cetyl ether sulfate, ammonium polyoxyethylene lauryl ether sulfate, and ammonium polyoxyethylene oleyl ether sulfate.

The dispersion stabilizers may be used each alone or two or more of them may be used in combination. In a case of using the slurry of the core particles obtained by using the anionic dispersant to be described later as the dispersion stabilizer as it is for the preparation of the functional particles, addition of the anionic dispersant in the aggregating step S11 for the manufacturing method of the functional particles can be saved. While the addition amount of the dispersion stabilizer is not particularly restricted, it is, preferably, in a range of from 0.05 to 10% by weight and, more preferably, from 0.1 to 3% by weight of the coarse powder slurry.

A viscosity improver, a surfactant, etc. can also be added together with the dispersion stabilizer to the coarse powder slurry. The viscosity improver is effective, for example, to further microparticulation of the coarse powder. The surfactant further improves, for example, the dispersibility of the synthetic resin coarse powder to water. As the viscosity improver, polysaccharide type viscosity improver selected from synthetic polymeric polysaccharides and natural polymeric polysaccharides are preferred. Known synthetic polymeric polysaccharides can be used and they include, for example, cationified cellulose, hydroxyethyl cellulose, starch, ionized starch derivatives, and block copolymers of starch and synthetic polymer. The natural polymeric polysaccharides include, for example, hyaluronic acid, carrageenan, locust beam gum, xanthan gum, guar gum, and gellan gum. The viscosity improvers may be used each alone or two or more of them may be used in combination. While the addition amount of the viscosity improver is not particularly restricted, it is preferably from 0.01 to 2% by weight based on the entire amount of the coarse powder slurry. The surfactant includes, for example, 2-sodium lauryl sulfosuccinate, 2-sodium lauryl polyoxyethylene sulfosuccinate, 2-sodium polyoxyethylene alkyl(C12 to C14) sulfosuccinate, 2-sodium polyoxyethylene lauroyl ethanol amide sulfosuccinate, and sulfosuccinate ester salt of sodium dioctyl sulfosuccinate. The surfactants may be used each alone or two or more of them may be used in combination. While the addition amount of the surfactant is not particularly restricted, it is preferably from 0.05 to 0.2% by weight based on the entire amount of the coarse powder slurry.

The synthetic resin coarse powder and the liquid are mixed by using a general mixer by which a coarse powder slurry is obtained. In this case, while there is no particular restriction for the addition amount of the synthetic resin coarse powder to the liquid, it is, preferably, from 3 to 45% by weight and, more preferably, from 5 to 30% by weight based on the total amount of the synthetic resin coarse powder, and the liquid. Further, while the synthetic resin coarse powder and water may also be mixed under heating or under cooling, they are usually conducted at a room temperature. The mixer includes, for example, Henschel type mixing devices such as Henschel mixer (trade name of products manufactured by Mitsui Mining Co., Ltd.), and Supermixer (trade name of products manufactured by Kawata Manufacturing Co. Ltd.), Mechanomill (trade name of products manufactured by Okada Seiko Co., Ltd.), Ongumill (trade name of products manufactured by Hosokawa Micron Corp.), Hybridization system (trade name of products manufactured by Nara Machinery Co., Ltd.), and Cosmo system (trade name of products manufactured by Kawasaki Heavy Industries Ltd.). The thus obtained coarse powder slurry may be served as it is to the pulverizing step S3 but a general pulverization treatment may be applied, for example, as a pretreatment and the synthetic resin coarse powder may be pulverized to a grain size of preferably about 100 μm and, more preferably, 100 μm or less. The pulverization treatment as the pretreatment is conducted, for example, by flowing the coarse powder slurry through a general pressure proof nozzle at a high pressure.

[Pulverizing Step S3]

In the pulverizing step S3, the coarse powder slurry obtained in the slurry preparing step S2 is pulverized under heating and pressure to obtain an aqueous slurry of core particles. For the heating and pressurization of the coarse powder slurry, the pressurizing unit 4 and the heaters 5 in the high pressure homogenizer 1 are used. For the pulverization of the coarse powder, the pulverizing nozzle 6 in the high pressure homogenizer 1 is used. While there is no particular restriction for the pressurizing and heating conditions of the coarse powder slurry, it is preferably pressurized to 50 to 250 MPa and heated to 50° C. or higher, more preferably pressurized to 50 to 250 MPa and heated to a melting point or higher of the synthetic resin contained in the coarse powder and, particularly preferably pressurized to 50 to 250 MPa and heated to a temperature from the melting point of the synthetic resin contained in the coarse powder to Tm+25° C. (Tm: ½ softening temperature of the synthetic resin in a flow tester). In a case where the coarse powder contains two or more synthetic resins, the melting point of the synthetic resin and the ½ softening temperature in the flow tester are, respectively, the values for the synthetic resin having the highest melting point or the ½ softening temperature. In a case where the pressure is less than 50 MPa, the shearing energy is decreased and pulverization may not possibly proceed sufficiently. In a case where the pressure exceeds 250 MPa, it is not practical since the risk is excessively high in the actual production line. The coarse powder slurry is introduced at the pressure and the temperature within the range described above from the inlet of the pulverizing nozzle 6 to the inside of the pulverizing nozzle 6. The aqueous slurry discharged from the exit of the pulverizing nozzle 6 contains, for example, the core particles and is heated to 60 to Tm+60° C. (Tm is as has been described above) and pressurized to about 5 to 80 MPa.

[Depressurizing Step S4]

In the depressurizing step S4, the aqueous slurry of the core particles in the heated and pressurized state obtained in the pulverizing step S3 is depressurized to an atmospheric pressure or a pressure approximate thereto while being kept in a state of not generating bubbling. For depressurization, the depressurizing module 7 in the high pressure homogenizer 1 is used. The aqueous slurry after the completion of the depressurizing step S4 contains, for example, core particles and the liquid temperature is about 60 to Tm+60° C. In the present specification, Tm is the softening temperature of the core particle.

In the present specification, the softening temperature of the synthetic resin was measured by using a fluidization property evaluation apparatus (trade name of products: flow tester CFP-100C, manufactured by Shimadzu Corp.). In the fluidizing property evaluation apparatus (flow tester CFT-100C), a load of 10 kgf/cm$^2$ (9.8×10$^5$ Pa) was applied and set such that 1 g of a specimen (carboxyl group-containing resin) was extruded from a die (nozzle; 1 mm bore diameter, 1 mm length), which was heated at a temperature elevation rate of 6° C./min and the temperature at which one-half amount of the sample was flown out of the die was determined as a softening temperature. Further, the glass transition temperature (Tg) of the synthetic resin or the resin particle was determined as described below. A DSC curve was measured by using a differential scanning calorimeter (trade name of products: DSC220, manufactured by Seiko Instruments Inc.) and heating 1 g of specimen (synthetic resin or resin particle) at a temperature elevation rate of 10° C./min in accordance with Japan Industrial Standards (JIS) K7121-1987. A temperature at the point of intersection between a line formed by extending the base line on a high temperature side of an endothermic peak of the obtained DSC curve corresponding to the glass transition to the low temperature side thereof, and a tangential line drawn at such a point that the gradient is maximum to a curve from the rising point to the top of the peak is determined as a glass transition temperature (Tg). The melting point of the synthetic resin can be determined as a melting peak temperature in the input compensated differential scanning calorimetry shown in JIS K-7121 when measuring at a temperature elevation rate of 10° C./min from a room temperature up to 150° C. by using a differential scanning calorimeter (DSC220). While a plurality of melting peaks are sometimes shown depending on the synthetic resin, the highest peak is defined as the melting point in the invention.

[Cooling Step S5]

In the cooling step S5, an aqueous slurry at a liquid temperature of 60 to Tm+60° C. (Tm is as described above) depressurized in the depressurizing step S4 is cooled to form a slurry at about 20 to 40° C. For cooling, the cooler 8 of the high pressure homogenizer 1 is used. Thus, an aqueous slurry containing core particles is obtained. The aqueous slurry can be used as it is for the preparation of the functional particles. Further, the core particles may also be isolated from the aqueous slurry and the core particles may be further slurrified and used as the raw material for the functional particles. For isolating the core particles from the aqueous slurry, general separation device such as filtration and centrifugation are used. In this preparation method, the grain size of the obtained core particles can be controlled by properly controlling the temperature and/or pressure applied to the aqueous slurry, the concentration of the coarse particles in the aqueous slurry, the number of pulverization cycles, etc. upon flowing through the pulverizing nozzle 6.

In the present specification, the volume average particle size and the coefficient of variation (CV value) are values determined as described below. 20 mg of a sample and 1 mL of sodium alkyl ether sulfate ester were added to 50 mL of an electrolyte (trade name of products: ISOTON-II, manufactured by Beckman Coulter Inc.) and applied with a dispersing treatment for 3 min at 20 kz of supersonic frequency by using a supersonic dispersing device (UH-50, trade name of products manufactured by STM Co.) to prepare a sample for measurement. For the sample used for the measurement, measurement was conducted by using a grain size distribution measuring apparatus (Multisizer 3, trade name of products manufactured by Beckman Coulter Ink.) under the condition at an aperture diameter of 20 μm, and the number of measured particles of 50,000 count, to determine the standard deviation in the volume average particle size and the volume grain size distribution based on the volume grain size distribution of the sampled particles. The coefficient of variation (CV value, %) was calculated according to the following equation:

$$\text{CV value (\%)} = \text{standard deviation in the volume grain size distribution/volume average grain size)} \times 100$$

[Shell Particle]

The shell particle is a resin particle or an inorganic particle with a volume average grain size smaller than that of the core particle. The volume average grain size of the shell particles is preferably, in a range of from 0.01 to 1.0 μm and, more preferably, from 0.03 to 0.5 μm. In a case where the volume average particle size of the shell particle is less than 0.01 μm, the shell particle is excessively small and less buried in the surface of the core particle. Accordingly, it takes a long time for coating the surface of the core particle with the shell particles and no further improvement is recognized for the property of the coating layer in view of the time. The adhesion of the coating layer to the core particles is sometimes weakened. In a case where the volume average particle size of the shell particle exceeds 1.0 μm, the core particle can not be coated sufficiently. Particularly, in a case where the core particle contains, for example, a colorant and the colorant is exposed to the surface thereof, the colorant exposed to the surface can not possibly be concealed sufficiently. Further, in a case where the core particle contains, for example, a release agent and the release agent bleeds-out to the surface, no further bleed-out of the release agent can not sometimes be prevented sufficiently. Further, this also results in a disadvantage that the thickness of the coating layer is excessively thick.

In a case where the shell particle is the resin particle, the glass transition temperature of the shell particle is not particularly restricted but it is preferably at about 45 to 75° C. Further, the glass transition temperature of the shell particle is set higher than the glass transition temperature of the core particle. It is preferably set such that the glass transition temperatures for both of them satisfy the following relation (2). By making the difference of the glass transition temperature between both of them to 15° C. or more, in a case of using a synthetic resin of lower glass transition temperature or softening temperature as the resin for core particle, the particle shape of the functional particle is kept as it is and the property of the functional particle less fluctuates. Further, the functional particles do not adhere to each other as well. Accordingly, the shell particle is selected depending on the volume average grain size and the glass transition temperature of the core particle. That is, among resin particles having preferred volume average particle size as the shell particle those having a volume average grain size smaller than the volume average grain size of the core particle and having a glass transition temperature higher than the glass transition temperature of the core particle may be selected and used as the shell particle.

$$Tg(s)-Tg(c)\geqq 15(^\circ\text{ C.}) \quad (2)$$

(where Tg(s) represents the glass transition temperature of the shell particle, and Tg(c) represents the glass transition temperature of the core particle).

While the shell particle as the resin particle can be manufactured by the same manufacturing method as the manufacturing method for the core particles by using the same synthetic resin as used for the core particle, shell particles synthesized by an emulsion polymerization method or a soap-free emulsion polymerization method are preferred. According to the emulsion polymerization method, the resin particle is obtained by conducting polymerization in a state where the monomer for polymerization is emulsified with an emulsifier in an aqueous medium. As the monomer for polymerization, (meth)acrylic acid, (meth)acrylate, styrene compounds, etc. can be used. Specific examples of the monomer for polymerization include, for example, alkyl(meth)acrylate compounds such as methyl(meth)acrylate, ethyl(meth)acrylate, n-butyl (meth)acrylate, isobutyl(meth)acrylate, and 2-ethylhexyl (meth)acrylate, and styrene compounds such as styrene, α-methylstyrene, vinyltoluene, and t-butylstyrene. In addition, ethylene, propylene, vinyl acetate, vinyl propionate, acrylonitrile, and methacrylonitrile, etc. can be used as the monomer for polymerization. Further, polyfunctional monomers such as divinyl benzene, ethylene glycol dimethacrylate, and trimethylolpropane triacrylate can also be used. The monomers for polymerization may be used each alone or two or more of them may be used in combination.

As the emulsifier, anionic surfactant, cationic surfactant, nonionic surfactant, and amphoteric surfactants can be used. The anionic surfactant includes, for example, fatty acid salts such as sodium oleate, alkyl sulfate ester salts such as ammonium lauryl sulfate, and alkyl benzene sulfonate salt such as sodium dodecyl benzene sulfonate. The cationic surfactant includes, for example, alkylamine salts such as laurylamine acetate, and quaternary ammonium salts such as stearyl trimethyl ammonium chloride. The nonionic surfactant includes, for example, polyoxyethylene alkyl ether, polyoxyethylene fatty acid ester, sorbitan fatty acid ester, and polyoxyethylene-oxypropylene block polymer. The amphoteric surfactant includes, for example, stearyl betain. Polymerization is conducted under the presence of a polymerization initiator.

The polymerization initiator includes, for example, a water soluble polymerization initiator and an oil soluble polymerization initiator. The water soluble polymerization initiator includes, for example, persulfates such as potassium persulfate and ammonium persulfate, hydrogen peroxide, 4,4'-azobiscyanovaleic acid, 2,2'-azobis(2-amidinopropane) dihydrogen chloride, t-butyl hydroperoxide, and cumene-hydroperoxide. The oil soluble polymerization initiator includes, for example, peroxides such as benzoyl peroxide and t-butyl perbenzoate and azo compounds such as azobis isobutyronitrile and azobis isobutyl valero nitrile. Among them, the water soluble polymerization initiator can be used preferably.

More specifically, the emulsification polymerization is conducted, for example, by emulsifying and dispersing one or more of monomers for polymerization in an aqueous medium containing an emulsifier, adding a polymerization initiator thereto and then heating them under stirring. The dispersion and emulsification of the monomer for polymerization is conducted, for example, by using a homomixer or homogenizer. The grain size of the resin particle to be formed can be controlled by adjusting the number of rotation of stirring. Further, the molecular weight of the resin to be formed can be controlled by adding a chain transfer agent to the polymerization reaction system. As the chain transfer agent, mercaptan compounds such as lauryl mercaptan and octyl thioglycolate, etc. can be used.

In a case where the shell particle is an inorganic particle, the shell particle is preferably one or more members selected from water insoluble inorganic particles and less water soluble inorganic particles considering that the functional particle is manufactured in an aqueous system. Known water insoluble inorganic particles can be used and they include, for example, inorganic oxides such as silica, titanium oxide, and alumina. The less water soluble inorganic particles are inorganic particles having a solubility to water at a normal temperature of 10 mg/100 g or less, preferably, 3 mg/100 g or less. Such inorganic particles include, for example, less water soluble alkali metal salts such as calcium carbonate and calcium phosphate. Among them, the less water soluble inorganic particles are preferred and less water soluble alkali metal salts are particularly preferred. Among inorganic particles referred to herein, those having preferred volume average grain size as the shell particle and with the volume average grain size smaller than that of the core particles can be selected and used as the inorganic particles.

(Manufacture of Functional Particle)

Figure 5:
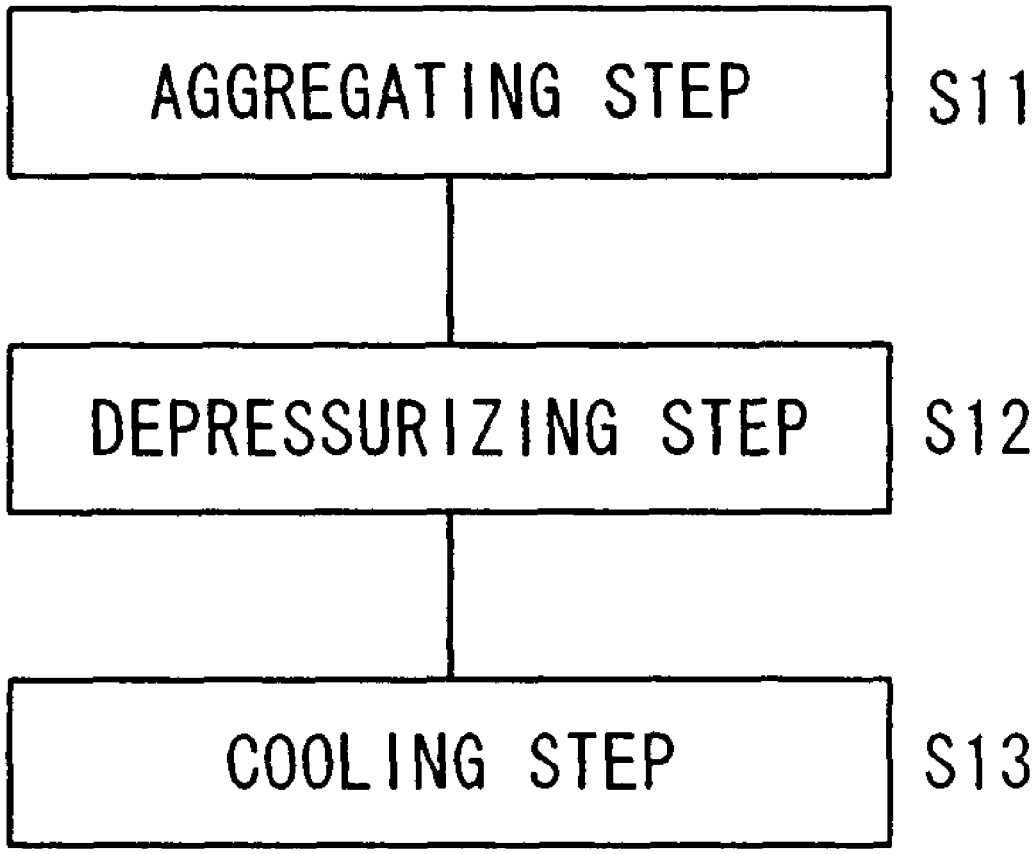
FIG. 5 is a flow chart schematically showing an example of a manufacturing method of a functional particle in the invention.

The functional particle can be obtained, for example, by the manufacturing method shown in FIG. 5. FIG. 5 is a flow chart schematically showing an example of a manufacturing method of the functional particle in the invention. The manufacturing method of the functional particle according to the invention shown in FIG. 5 includes an aggregating step S11, a depressurizing step S12, and a cooling step S13.

[Aggregating Step S11]

In this step, an aqueous mixed slurry containing core particles and shell particles (hereinafter referred to simply as "mixed slurry" unless otherwise specified) is prepared. Then, by flowing the mixed slurry through a coiled pipeline under heating and pressurization, shell particles are agglomerated and deposited on the surface of the core particles to obtain an aqueous slurry of functional particles in which the coating layer containing the shell particles is formed on the surface of the core particle (hereinafter referred to "functional particle slurry" unless otherwise specified). While the solid concentration in the mixed slurry (total concentration for the core particles and the shell particles) is not particularly restricted, it is preferably in a range of from 2 to 40% by weight and, more preferably, from 5 to 20% by weight based on the entire amount of the mixed slurry. In a case where it is less than 2% by weight, the cohesion force of the shell particles to the core particles decreases possibly making it difficult for the grain size control. In a case where it is 40% by weight or more, excess aggregation of the shell particles may possibly occur on the surface of the core particle. Further, while there is no particular restriction for the ratio of use between the core particles and the shell particles, it is preferably from 5 to 20 parts by weight and, more preferably, from 7 to 13 parts by weight based on 100 parts by weight of the core particles.

A cationic dispersant can be added to the mixed slurry. The dispersibility of the shell particles in the mixed slurry is lowered by the addition of the cationic dispersant. By flowing the mixed slurry in this state through the pipe-shape pipeline, aggregation of the shell particles on the surface of the core particle proceeds smoothly with no trouble to obtain functional particles with less variation in the shape and the grain size. That is, in the invention, the cationic dispersant acts also as an aggregating agent. Known cationic dispersants can be used and preferred dispersants include, for example, alkyl trimethyl ammonium type cationic dispersant, alkylamide amine type cationic dispersant, alkyldimethyl benzyl ammonium salts cationic dispersant, cationified polysaccharide type cationic dispersant, alkyl betain type cationic dispersant, alkylamide betain type cationic dispersant, sulfobetain type cationic dispersant, and amine oxide type cationic dispersant. Among them, the alkyltrimethyl ammonium type cationic dispersant is further preferred. Specific examples of the alkyltrimethyl ammonium type cationic dispersant include, for example, ammonium stearyl trimethyl chloride, ammonium tri(polyoxiethylene) stearyl chloride, and ammonium lauryltrimethyl chloride. The cationic dispersants may be used each alone or two or more of them may be used in combination. The cationic dispersant is used, for example, by being added to the mixed slurry. While the addition amount of the cationic dispersant is not particularly restricted and can be properly selected from a wide range, it is preferably in a range of from 0.1 to 5% by weight based on the entire amount of the mixed slurry. In a case where the addition amount is less than 0.1% by weight, the ability of weakening the dispersibility of the shell particles is insufficient to possibly render the aggregation of the shell particle insufficient. In a case where the addition amount exceeds 5% by weight, the dispersing effect of the cationic dispersant is developed possibly making the aggregation insufficient.

In the mixed slurry, the anionic dispersant may also be added together with the cationic dispersant. In a case where the synthetic resin as the matrix ingredient of the shell particle is a resin other than the self-dispersible resin, the anionic dispersant is preferably added to the mixed slurry. The anionic dispersant has an effect of improving the dispersibility of the core particles in water and the addition thereof mainly prevents excess aggregation of the shell particles. Accordingly, by adding the anionic dispersant to the mixed slurry and, further, adding the cationic dispersant, aggregation of the core particle proceeds smoothly, occurrence of excess aggregation is prevented and the functional particles of narrow grain size distribution width can be produced efficiently. The anionic dispersant may also be added to the coarse powder slurry in the stage of preparing the course powder slurry. Known anionic dispersant can be used and they include, for example, sulfonic acid type anionic dispersant, sulfate ester type anionic dispersant, polyoxyethylene ether type anionic dispersant, phosphate ester type anionic dispersant, and polyacrylate salt. As specific examples of the anionic surfactant, sodium dodecylbenzene sulfonate, sodium polyacrylate, and polyoxyethylene phenyl ether, etc. can be used preferably. The anionic dispersants can be used each alone or two or more of them can be used in combination. While the addition amount of the anionic dispersant is not particularly restricted, it is preferably in a range of from 0.1 to 5% by weight based on the entire amount of the mixed slurry. In a case where it is less than 0.1% by weight, the dispersing effect of the shell particle due to the anionic dispersant is insufficient to possibly cause excess aggregation. Even in a case where it is added in excess of 5% by weight, the dispersing effect is no more improved and the dispersibility of the shell particles is rather lowered by the increased viscosity of the mixed slurry. As a result, this may possibly cause excess aggregation. Further, the ratio of using the cationic dispersant and the anionic dispersant is not particularly restricted and there is no particular restriction so long as they are at a ratio of lowering the dispersing effect of the anionic dispersant by the use of the cationic dispersant. However, the anionic dispersant and the cationic dispersant are desirably used at a weight ratio, preferably, of 10:1 to 1:10, more preferably, from 10:1 to 1:3 and, particularly preferably, from 5:1 to 1:2 considering easy grain size control of the functional particles, easy occurrence of aggregation, prevention for the occurrence of excess aggregation, further narrowing for the grain size distribution width of the functional particles.

The mixed slurry is heated in the coiled-shape pipeline at a temperature of the glass transition temperature or higher of the core particle. Then, only the core particles are softened selectively and the shell particles are deposited and agglomerated on the surface of the core particle. Since the softening of the core particles does not proceed at the heating temperature of lower than the glass transition temperature of the core particle, the shell particles less deposit to the surface of the core particle. Further, in a case where the shell particle is a resin particle, it is preferred that the heating temperature of the mixed slurry in the coiled pipeline satisfies the following relation (1). That is, it is preferred that the heating temperature of the mixed slurry in the coiled pipeline is higher than the glass transition temperature of the coil particle and lower than the glass transition temperature of the shell particle. Further, it is preferred that the glass transition temperature of the shell particle is lower than the melting point of the core particle. Accordingly, it is preferred to select, as the shell particle, a resin particle having a glass transition temperature in a temperature region between the glass transition temperature and the melting point of the core particle. With the constitution described above, since only the core particle is softened, a functional particle in which the shell particles are deposited and solidified so as to be buried in the surface of the core particle is obtained, and aggregation between each of the shell particles is prevented. Further, the mixed slurry is pressurized in the coiled pipeline. While the pressurizing pressure is not particularly restricted, it is, preferably, from 5 to 100 MPa and, more preferably, from 5 to 20 MPa. In a case where the pressure is less than 5 MPa, the mixed slurry does not smoothly flow through the coiled pipeline. In a case where the pressurizing pressure exceeds 100 MPa, aggregation of the shell particles scarcely occurs.

$$Tg(c)<A<Tg(s)<MP(c) \quad (1)$$

(where A represents a heating temperature of the mixed slurry in the coiled pipeline, Tg(c) represents a glass transition temperature of the core particle, Tg(s) represents the glass transition temperature of the shell particle, and Mp(c) represents the melting point of the core particle).

The coiled pipeline for causing the mixed slurry to flow therethrough is a member comprising a pipe-shaped pipeline having a flow channel at the inside wound in a coiled or spiral shape. The number of turns of the coil of the coiled pipeline, is preferably, in a range of from 1 to 200, more preferably, from 5 to 80 and, particularly preferably, from 20 to 60. In a case where the number of turns of the coil is less than 1, not the core particles but the functional particles having an appropriate grain size cause aggregation to form coarse particles. In a case where the number of turns of the coil exceeds 200, since the time for applying the centrifugal force increases, control for grain size is difficult. As a result, the yield of the functional particles having an appropriate grain size is lowered. In a case where the number of turns of the coil is within a range from 20 to 60, grain size control is particularly easy and functional groups uniform in the shape and the grain size can be obtained at a good yield. Further, while the coil radius of one coil is not particularly restricted, it is, preferably, in a range of from 25 to 200 mm and, particularly preferably, from 30 to 80 mm. In a case where the coil radius is less than 25 mm, an angular velocity becomes predominant in the flow channel of the coiled pipeline, and the core particles tend to be localized stably to the inner wall surface and the vicinity thereof of the flow channel. As a result, core particles tend to agglomerate excessively making it difficult for the grain size control and lowering the yield of the functional particles having an appropriate grain size. In a case where the coil radius exceeds 200 mm, the centrifugal force increases in the flow channel making it difficult for the occurrence of a turbulence flow to decrease the possibility that the core particles collide against each other and aggregation of the core particles less occur. Accordingly, control for the grain size becomes difficult and the yield of the functional particles having an appropriate grain size is lowered.

While the reason why aggregation occurs by the flow of the mixed slurry through the coiled pipeline in a heated and pressurized state has not yet been apparent sufficiently, it may be considered as below. The mixed slurry flows through the flow channel of a linear pipeline while forming a laminar flow. In the laminar flow, particles of a large grain size flow at the center of the flow channel being substantially arranged orderly, while particles of a small grain size flow near the inner wall surface being substantially arranged orderly. In this case, since disturbance is not present in the flow, particles less collide against each other and aggregation scarcely occurs. On the other hand, in a case where the mixed slurry is introduced into a pipe-shaped pipeline, a centrifugal force F directed outward of the flow channel exerts near the inner wall surface of the flow channel. The centrifugal force F is represented as: $F=mr\omega^2$ (in the formula, "m" represents the mass of an object applied with a centrifugal force, "r" represents a radius of rotation, which is a coil radius herein, and "ω" represents the angular velocity). In a system where large particles (core particles) and small particles (shell particles) are present together, small particles of a higher transfer speed undergo higher centrifugal force. Accordingly, the shell particles as the small particles move at first to the vicinity of the wall surface in the flow channel of the coiled pipeline and, subsequently, the core particles as the large particles softened under heating to a glass transition temperature or higher move to the vicinity of the wall surface in the flow channel. Then, the shell particles that have moved previously are deposited and agglomerated on the surface of the softened core particles. In view of the above, it is preferred to determine the mass of the core particles, the mass of the shell particles, the angular velocity of the core particles, and the angular velocity of the shell particles such that the following relation (3) is satisfied. This can form a coating layer with a further uniform thickness on the surface of the core particles. In a case where the surface of the core particle is coated with the shell particles, since the shell particles per se are not softened and do not exhibit tackiness, excess aggregation less occurs.

$$m(c)/m(s)<(\omega(s)/\omega(c))^2 \quad (3)$$

(where m(c) represents the mass of the core particles, m(s) represents the mass of the shell particles, ω(c) represents the angular velocity of the core particles, and the ω(s) represents the angular velocity of the shell particle).

[Depressurizing Step S12]

In the depressurizing step S12, the functional particle slurry in the heated and pressurized state obtained in the aggregating step S11 is depressurized to an atmospheric pressure or pressure approximate thereto such that bubbling caused by bumping does not occur. Grain size adjustment is conducted along with depressurization. The grain size adjustment is mainly decrease of the diameter of the coarse particles. Accordingly, the functional particle slurry after the depressurization scarcely contains coarse particles but contains functional particles with substantially uniform shape and grain size, and the liquid temperature is about 50 to 80° C.

Figure 6:
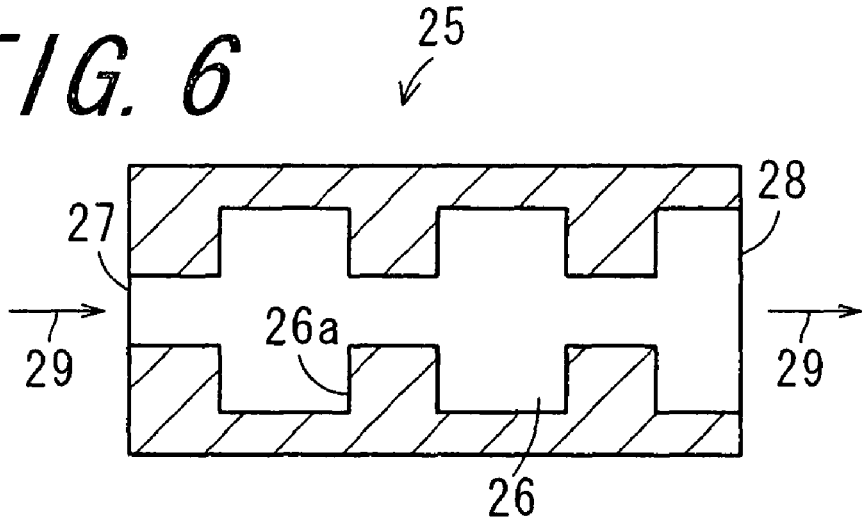
FIG. 6 is a cross sectional view in a longitudinal direction schematically showing a constitution of a depressurizing nozzle.

Depressurization of the functional particle slurry is conducted, for example, by using the depressurizing nozzle. As the depressurizing nozzle, a depressurizing nozzle 25 shown in FIG. 6 can be used for example. FIG. 6 is a cross sectional view in the longitudinal direction schematically showing the constitution of the depressurizing nozzle 25. A flow channel 26 is formed to the depressurizing nozzle 25 so as to penetrate the inside thereof in the longitudinal direction. The flow channel 26 has one end as an inlet 27 and the other end as an exit 28 in the longitudinal direction. A functional particle slurry in the heated and pressurized state is introduced from the inlet 27 into the depressurizing nozzle 25, and a functional particle slurry in the depressurized and heated state is discharged from the exit 28 to the outside of the depressurized nozzle 25. The flow channel 26 is formed such that the longitudinal axial line thereof aligns with the longitudinal axis of the depressurizing nozzle 25, and the exit diameter is larger than the inlet diameter. Further, in this embodiment, portions having a relatively smaller cross sectional diameter and portions having a relatively large cross sectional diameter in the direction perpendicular to the slurry flowing direction (direction along an arrow 29) are formed such that they are in contiguous alternately to each other in the flow channel 26. Further, it is configurated such that a portion having a relatively smaller cross sectional diameter is formed near the inlet 27, while a portion of a relatively large cross sectional diameter is formed near the exit 28 of the flow channel 26. When a functional particle slurry in a heated and pressurized state is introduced from the inlet 27 to the flow channel 26 of the depressurizing nozzle 25, the slurry flows through the inside of the flow channel 26 while undergoing depressurization. Then, among the functional particles, only the particles of an excessively large particle size are in contact with the inner wall surface 26*a* of the flow channel 26, by which excessive shell particles are dissociated to form functional particles of an appropriate size, and they are discharged from the exit 28. In the depressurizing nozzle 25, since the exit diameter is larger than the inlet diameter in the flow channel 26, the slurry is in contact with the inner wall surface 26*a* and applied with an appropriate shearing force. Accordingly, only the functional particles having an excessively large grain size (coarse particles) undergo the grain size control. Further, in the agglomerates formed by the core particles to each other, dissociation of the core particles occur. On the other hand, in a case where the inlet diameter is larger than the exit diameter, since an intense shearing force is applied, shell particles are detached not only from the functional particles having an excessively large grain size but also from other functional particles than described above. Accordingly, the width for the grain size distribution of the functional particles increases more unnecessarily.

Figure 7:
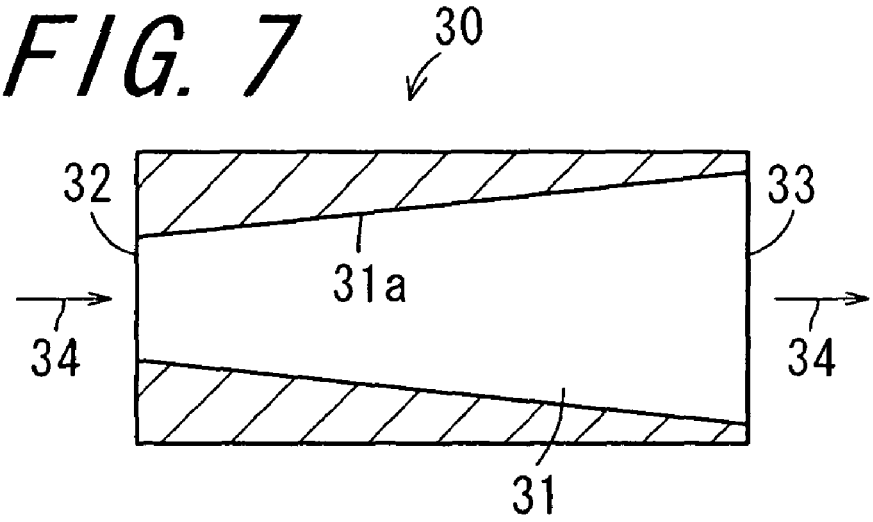
FIG. 7 is a cross sectional view in a longitudinal direction schematically showing a constitution of a depressurizing nozzle in another embodiment.

In this embodiment, various types of depressurizing nozzles having flow channels formed such that the exit diameter is larger than the inlet diameter can be used not being restricted only to the depressurizing nozzle 25. By making the exit diameter larger than the inlet diameter, formation of coarse particles due to the re-aggregation of functional particles pulverized appropriately in the depressurizing nozzle is prevented. FIG. 7 is a cross sectional view in the longitudinal direction schematically showing the constitution of a depressurizing nozzle 30 in another embodiment. In the depressurizing nozzle 30, a flow channel 31 is formed so as to pass through the inside in the longitudinal direction. The flow channel 31 has one end as an inlet 32 and the other end as an exit 33. The flow channel 31 is formed such that the longitudinal axial line thereof aligns with the longitudinal axial line of the depressurizing nozzle 30, and the exit diameter is larger than the inlet diameter. Further, in this embodiment, the flow channel 31 is formed such that the cross sectional diameter in the direction perpendicular to the slurry flowing direction (direction along an arrow 34) is enlarged continuously and gradually from the inlet 32 to the exit 33. The depressurizing nozzle 30 has the same effect as that of the depressurizing nozzle 25. Further, in this embodiment, the depressurizing module 7 in the high pressure homogenizer 1 can also be used not being restricted only to the depressurizing nozzle.

In this embodiment, the shape and the grain size of the functional particles are made more uniform by arranging the coiled pipelines and the depressurizing nozzles or depressurizing modules alternately each in plurality and conducting aggregation and depressurization alternately and repetitively. Assuming the combination of the coiled pipeline and the depressurizing nozzle or the depressurizing module as one set, it is preferred to dispose them by 2 to 5 sets. Only with one set, the grain size control for the functional particles can not possibly be conducted sufficiently. On the contrary, even when they are disposed in excess of 5 sets, no further improvement can be expected for the effect of the grain size control but this further results in a problem of complicating the constitution of the apparatus.

[Cooling Step S13]

In the cooling step S13, the functional particle slurry at a liquid temperature of about 50 to 80° C. obtained in the depressurizing step S12 is cooled. Functional particles are obtained by separating the functional particles from the functional particle slurry and then drying them after optionally cleaning them. For the separation of the functional particles, usual solid-liquid separation device can be adopted such as filtration, centrifugation, and decantation. The functional particles are cleaned in order to remove not agglomerated core particles and shell particles, anionic dispersant, cationic dispersant, etc. Specifically, cleaning is conducted by using, for example, purified water at a conductivity of 20 μS/cm or lower. The functional particles and pure water are mixed and, the cleaning with pure water is conducted repetitively till the electroconductivity of the cleaning water after separating the functional particles from the mixture is lowered to 50 μS/cm or lower. By drying after the cleaning, the functional particles of the invention can be obtained. The functional particles of the invention preferably have a volume average grain size of about 5 to 6 μm, uniform shape and grain size, and an extremely narrow within of the grain size distribution. For obtaining the functional particles of the invention having the volume average grain size of about 5 to 6 μm, it is important, for example, to complete the treatment in an optimal time. In the invention, a depressurizing step may also be disposed just after the cooling step S13. The pressurizing step is identical with the depressurizing step S12.

Figure 8:
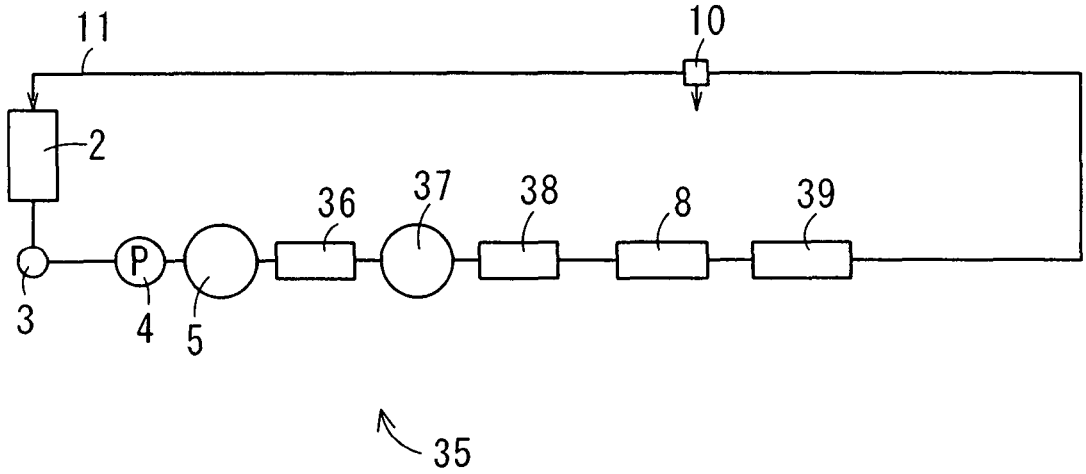
FIG. 8 is a system chart schematically showing a simplified constitution of a high pressure homogenizer in another embodiment.

The aggregating method described above can be practiced, for example, by using a high pressure homogenizer described in WO 03/059497. FIG. 8 is a system chart schematically showing the constitution of a high pressure homogenizer 35 for practicing the method of manufacturing functional particles of the invention shown in FIG. 5. The high pressure homogenizer 35 is similar to the high pressure homogenizer 1 in which corresponding portions carry identical reference numerals and descriptions therefore are to be omitted. The high pressure homogenizer 35 is different from the high pressure homogenizer 1 in that it does not include the pressurizing nozzle 6 but includes depressurizing modules 36, 38, 39 different from the depressurizing module 7 and includes a coiled pipeline 37. The high pressure homogenizer 35 is a high pressure homogenizer not pulverizing the particles but aggregating the particles. The high pressure homogenizer 35 includes a tank 2, a delivery pump 3, a pressurizing unit 4, a heater 5, a pressurizing module 36, a coiled pipeline 37, a depressurizing module 38, a cooler 8, a depressurizing module 39, a pipeline 9, and a dispensing port 10. In the high pressure homogenizer 35, the tank 2, the delivery pump 3, the pressurizing unit 4, the heater 5, the depressurizing module 36, the coiled pipeline 37, the depressurizing module 38, the cooler 8, and the depressurizing module 39 are connected in this order by way of a pipeline 9. In the system connected by the pipeline 9, the slurry after being cooled by the cooler 8 may be taken out from the dispensing port 10 to the outside of the system, or the slurry after being cooled by the cooler 8 may be returned again to the tank 2 and then circulated repetitively in the direction along an arrow 11.

The tank 2, the delivery pump 3, and the pressurizing unit 4 identical with those in the high pressure homogenizer 1 are used. The mixed slurry in the tank 2 is delivered in a state pressurized by the delivery pump 3 and the pressurizing unit 4 to the heater 5. Also the heater 5 identical with that in the high pressure homogenizer 1 is used. That is, a heater 5 including a not illustrated coiled pipeline and a not illustrated heating portion is used. Both ends of the coiled pipeline are connected respectively to the pipeline 9. The mixed slurry is heated and pressurized by flowing through the heater 5, and supplied to the depressurizing module 36. For the depressurizing module 36, a depressurizing nozzle is used, for example. The pressurizing nozzle is a nozzle formed in which a flow channel is formed so as to penetrate the inside thereof in the longitudinal direction. The flow channel has one end as the inlet and the other end as the exit in the longitudinal direction and is formed such that the exit diameter is larger than the inlet diameter. The inlet and the exit are connected respectively to the pipeline 9, the slurry in the heated and pressurized state is introduced from the inlet into the flow channel, and the depressurized slurry is discharged from the exit. The depressurizing nozzle includes, for example, the depressurizing nozzle 25 or 30. Further, instead of the depressurizing nozzle, the depressurizing module 7 in the high pressure homogenizer 1 can also be used. Coarse particles formed in the heater 5 are pulverized by the depressurizing module 36. An aggregating step for the core particles is conducted in the coiled pipeline 37, to obtain a functional particle slurry. For the coiled pipeline 37 the pipeline identical with that described for the aggregating step S11 can be used. The depressurizing step is conducted in the depressurizing module 38. That is, the functional particle slurry is depressurized and, simultaneously, only the coarse particles are selectively pulverized to control the grain size for the functional particles. A cooling step is conducted in the cooler 8 and the functional particle slurry is cooled. The cooling device 8 identical with that of the high pressure homogenizer 1 is used. The cooled functional particle slurry undergoes the grain size control again in the depressurizing module 39 to obtain the functional particles of the invention.

According to the high pressure homogenizer 35, a mixed slurry is at first filled in the tank 2 and, after addition of a cationic aggregating agent, introduced to the coiled pipeline of the heater 5 into a heated and pressurized state. Then, after undergoing pulverizing of the coarse particles by the pressurizing module 36, centrifugal force and the shearing force are applied to the core particles under heating and pressurization by the coiled pipeline 37 in which the core particles are agglomerated selectively to form a functional particle slurry. The functional particle slurry is then introduced into the depressurizing module 38 and undergoes depressurization, and core particles are detached from the functional particles having an excess grain size to make the grain size of the functional particles uniform. The functional particle slurry is introduced into the cooler 8 and, after cooling, undergoes the grain size control again in the depressurizing module 39. Thus, the aggregating step S11—depressurizing step 12—cooling step S13 are completed. Such a series of steps may be conducted repetitively. In this case, the functional particle slurry obtained in the cooling step S13 is circulated again to the tank 2 and applied with the same treatment again.

Figure 9:
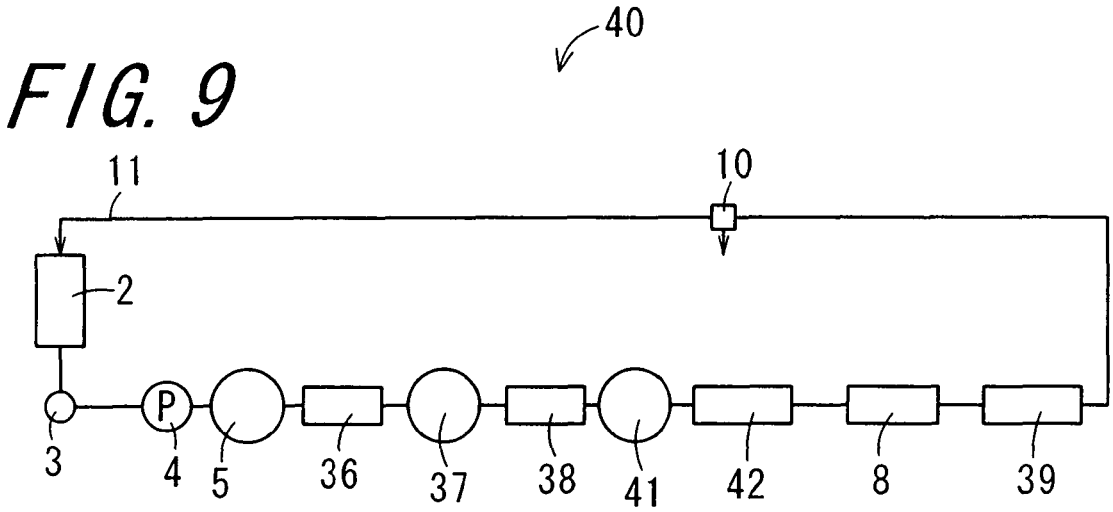
FIG. 9 is a system chart schematically showing a simplified constitution of a high pressure homogenizer in another embodiment.

FIG. 9 is a system chart schematically showing the constitution of a high pressure homogenizer 40 of an other embodiment. A high pressure homogenizer 40 is similar to the high pressure homogenizer 35 in which corresponding portions carry identical reference numerals for which descriptions are to be omitted. In the high pressure homogenizer 40, a coiled pipeline 41 and a depressurizing module 42 are disposed between a depressurizing module 38 and a cooler 8 in the high pressure homogenizer 35. The coiled pipeline 41 is identical with that described in the paragraph for the aggregating step S11. The depressurizing module 42 is identical with the pressurizing module 36. According to the high pressure homogenizer 40, by providing a plurality of sets each comprising the coiled pipeline and the depressurizing module as one set, aggregation of the core particles and the grain size control for the functional particles having an excess grain size (reduction of diameter) are conducted repetitively. Accordingly, the grain size of the functional particles is made further uniform, and the width for the grain size distribution of the functional particles obtained finally is further narrowed.

EXAMPLES

The invention is to be described specifically with reference to manufacturing examples, preferred examples and comparative examples. In the followings, "parts" and "%" means respectively "part by weight" and "% by weight" unless otherwise specified.

Production Example 1

Preparation of Coarse Powder Slurry 100 parts of a polyester resin (glass transition temperature Tg: 60° C., softening temperature Tm: 110° C.) were melted and kneaded by a twin screw extruder (PCM-30, trade name of products manufactured by Ikegai Ltd.) at a cylinder temperature of 145° C. and a number of rotation of a barrel of 300 rpm to prepare a molten kneaded mixture for a toner material. After cooling the molten kneaded product to a room temperature, it was coarsely pulverized by a cutter mill (VM-16; trade name of products manufactured by SEISHIN ENTERPRISING CO., LTD.), to prepare a coarse powder with a grain size of 100 μm or less. 40 g of the coarse powder, 13.3 g of xanthan gum, 4 g of sodium dodecyl benzene sulfonate (LUNOX S-100, trade name of products for anionic dispersant manufactured by Toho Chemical Industry Co., Ltd.), 0.67 g of sulfosuccinic acid surfactant (trade name: Airol CT-1P, main ingredient: sodium dioctyl sulfosuccinate salt manufactured by Toho Chemical Industry Co., Ltd.), and 742 g of water were mixed and the obtained mixture was charged in a mixer (New Generation Mixer NGM-1.5TL, trade name of products manufactured by Beryu Co.) and, after stirring at 2000 rpm for 5 min, deaerated to prepare a coarse slurry.

[Preparation of Core Particles]

800 g of the coarse powder slurry obtained as described above was charged into a tank of a high pressure homogenizer (NANO 3000, trade name of products manufactured by Beryu Co.), circulated in a high pressure homogenizer kept at a temperature of 100° C. and under a pressure of 210 MPa for 40 min to prepare an aqueous slurry containing core particles with a volume average particle size of 4.2 μm, a CV value of 25%, a glass transition temperature of 53° C., and a melting point of 107° C. The high pressure homogenizer used herein is the high pressure homogenizer 1 for pulverizing shown in FIG. 2. In this case, a pressure at 210 MPa was applied to the slurry in the pressurizing unit 4. The slurry was heated to 120° C. or higher in the heater 5. The coiled pipeline in the heater 5 had a coil inner diameter of 4.0 mm, a coil radius (coil radius of curvature) of 40 mm, and a number of turns of the coil of 50. As the pulverizing nozzle 6, a nozzle having a nozzle length of 0.4 mm in which a flow channel of 0.09 mm diameter formed through the nozzle in the longitudinal direction was used. For the depressurizing module 7, the depressurizing nozzle 20 shown in FIG. 4 was used. In this example, the nozzle length was 150 mm, the nozzle inlet diameter was 2.5 mm, and the nozzle exit diameter was 0.3 mm.

Production Example 2

Preparation of Core Particles

An aqueous slurry containing core particles with a volume average grain size of 4.4 μm, a CV value of 23%, a glass transition temperature of 53° C., and a melting point of 110° C. was prepared in the same manner as the Production Example 2 except for using, instead of 100 parts of the polyester resin, 100 parts of a mixture obtained by mixing 87.5 parts of a polyester resin, 1.5 parts of a charge controller (TRH, trade name of products manufactured by Hodogaya Chemical Co. Ltd.), 3 parts of a polyester wax (melting point: 85° C.), and 8 parts of a colorant (KET. BLUE 111) by a mixer (Henschel mixer, trade name of products manufactured by Mitsui Mining Co).

Production Example 3

Preparation of Shell Particles

An anchor type stirring blade was attached to a separable flask, and 0.1 parts of ammonium dodecyl sulfonate (emulsifier) dissolved in 390 parts of ion exchanged water was charged and heated to a temperature of 80° C. The temperature was kept at 80° C. and an aqueous solution comprising one part of 2,2'-azobis-2-amidinopropane dihydrochloride (polymerization initiator, V-50, trade name of products manufactured by Wako Pure Chemical Industries Ltd.), and 10 parts of ion exchanged water, and a mixture comprising monomers for polymerization (10 parts of styrene monomer, 40 parts of methyl methacrylate, and 15 parts of n-butyl methacrylate) and one part of octyl thioglycolate (chain transfer agent) were dropped respectively for 60 min. After 30 min from the completion of dropping, a mixed monomer comprising 10 parts of styrene, 15 parts of methyl methacrylate, and 5 parts of n-butyl methacrylate was dropped for 30 min. After completion of the dropping, they were stirred at 80° C. for 2 hours to complete polymerization and obtain an emulsion of styrene-acryl resin particles at a solid concentration of 20%. The emulsion was applied with washing and drying to obtain styrene-acryl resin particles (shell particles) with a volume average particle size of 1.11 μm and a glass transition temperature of 68° C. The polymerizing reaction was conducted under stirring. The rotational speed of the stirring blade was 250 rpm.

Production Examples 4 to 7

Preparation of Shell Particles

Styrene-acryl resin particles having the property shown in Table 1 were produced in the same manner as in Production Example 3 except for changing the rotational speed of the stirring blade to the rotational speed described in Table 1.

Production Example 8

Preparation of Shell Particles

Styrene-acryl resin particles having the property shown in Table 1 were produced in the same manner as in Production Example 3 except for changing the rotational speed of the stirring blade from 250 rpm to 500 rpm and changing the amount of methyl methacrylate from 15 parts to 10 parts upon second dropping of the mixed monomer.

TABLE 1

| | Stirring speed (rpm) | Glass transition temperature (° C.) | Melting point (° C.) | Volume average grain size (μm) | CV value (%) |
|---|---|---|---|---|---|
| Production Example 3 | 250 | 68 | 123 | 1.11 | 25 |
| Production Example 4 | 300 | 68 | 123 | 1.03 | 25 |
| Production Example 5 | 400 | 68 | 123 | 0.75 | 25 |
| Production Example 6 | 500 | 68 | 123 | 0.62 | 22 |
| Production Example 7 | 550 | 68 | 123 | 0.49 | 23 |
| Production Example 8 | 500 | 65 | 119 | 0.74 | 23 |

Example 1

A mixed slurry was prepared by dispersing 500 g of the core particles of Production Example 1 and 2.5 g of shell particles comprising calcium carbonate ($CaCO_3$, a melting point of 839° C., a volume average grain size of 0.81 μm, a CV value of 28%) in 0.1 liter of water. The entire amount of the slurry and 10 g of an aqueous 20% solution of stearyl trimethyl ammonium chloride (Coatamin 86W, trade name of products manufactured by Kao Corp.) were charged in a mixture (New Generation Mixer: NGM-1.5TL), stirred at 2000 rpm for 5 min and then deaerated to prepare a mixed slurry containing a cationic dispersant. The entire amount of the mixed slurry was charged in a tank of a high pressure homogenizer, and the slurry was circulated under heating and pressure at 75° C. and 13 MPa in the high pressure homogenizer for 40 min to produce a functional particle slurry containing the functional particles of the invention. The high pressure homogenizer used herein is the high pressure homogenizer 35 for particle aggregation shown in FIG. 8 partially modified from a high pressure homogenizer (NANO3000, trade name of products manufactured by Beryu Co., Ltd.) The coiled pipeline in the heater 5 has a coil inner diameter 4.0 mm, a radius (radius of curvature) of 40 mm, and a number of coil turns of 50. The radius of curvature of coil of the coiled pipeline 37 was 38 mm and the number of turns was 54. For the depressurizing modules 36, 38, and 39, the depressurizing nozzle 30 shown in FIG. 7 was used. In this example, the nozzle length was 150 mm, the nozzle inlet diameter was 0.3 mm, and the nozzle exit diameter was 2.5 mm. The functional particle slurry obtained as described above was filtered to recover functional particles, which were washed with water for five times and dried by a hot blow at 75° C. to produce functional particles of the invention. The functional particle had a volume average particle size (μm) and a CV value (%) as shown in Table 2.

Examples 2 to 10

Comparative Examples 1 to 8

Functional particles as the products of the invention and comparative products were produced in the same manner as in Example 1 except for changing the core particles and the shell particles, the heating temperature in the high pressure homogenizer 35, presence or absence of the coiled pipeline 37, position for disposing and the number of setting the depressurizing module 38 as shown in Table 2. The volume average particle size (μm) and the CV value (%) of the functional particles are also shown together in Table 2. In the Production Example 2, encapsulation was conducted by using a modified apparatus in which the coiled pipeline 37 was removed in the high pressure homogenizer 35 and the depressurizing module 36 and the depressurizing module 38 were connected directly. Further, while the depressurizing module 38 is usually disposed just after the coiled pipelined 37 as shown in FIG. 8, the depressurizing module 38 was disposed before the coiled pipeline 37 in Comparative Example 3. That is, "before the coil" means positioning of the depressurizing module 38 before the coiled pipeline 37 and "after the coil" means positioning of the coiled pipeline 37 before the depressurizing module 38. Further, "set" means one coiled pipeline 37 and one depressurizing module 38 connected in this order and "1 set" means disposing the set by the number of 1 and "2 sets" means connecting the sets by the number of 2. This is applicable also in a case where the number of sets increases.

TABLE 2

| | | Core particle | Schell particle | Tg difference | Aggregating - depressurizing device: Heating temperature ° C. | Presence or absence of Coiled pipeline | Position for depressurizing module | Number of set | Functional particle: Volume average grain size μm | CV value % |
|---|---|---|---|---|---|---|---|---|---|---|
| Example | 1 | Production Example 1 | $CaCO_3$ | — | 75 | presence | after coil | 1 | 6.3 | 31 |
| | 2 | Production Example 1 | $CaCO_3$ | — | 75 | presence | after coil | 2 | 5.9 | 28 |
| | 3 | Production Example 1 | $CaCO_3$ | — | 75 | presence | after coil | 3 | 5.6 | 24 |
| | 4 | Production Example 1 | $CaCO_3$ | — | 75 | presence | after coil | 4 | 5.3 | 22 |
| | 5 | Production Example 1 | $CaCO_3$ | — | 75 | presence | after coil | 5 | 5.2 | 21 |
| | 6 | Production Example 1 | $CaCO_3$ | — | 75 | presence | after coil | 6 | 4.8 | 23 |
| | 7 | Production Example 1 | Production Example 5 | 15 | 61 | presence | after coil | 1 | 6.4 | 32 |
| | 8 | Production Example 1 | Production Example 4 | 15 | 61 | presence | after coil | 1 | 6.5 | 30 |
| | 9 | Production Example 1 | Production Example 6 | 15 | 61 | presence | after coil | 1 | 7.8 | 32 |
| | 10 | Production Example 2 | Production Example 5 | 15 | 65 | presence | after coil | 5 | 5.4 | 22 |
| Comparative Example | 1 | Production Example 1 | $CaCO_3$ | — | 50 | presence | after coil | 1 | 3.6 | 48 |
| | 2 | Production Example 1 | $CaCO_3$ | — | 75 | absence | after coil | 1 | 3.8 | 44 |
| | 3 | Production Example 1 | $CaCO_3$ | — | 75 | presence | before coil | 1 | 8.9 | 45 |
| | 4 | Production Example 1 | $CaCO_3$ | — | 110 | presence | after coil | 1 | 7.8 | 40 |
| | 5 | Production Example 1 | Production Example 5 | 15 | 75 | presence | after coil | 1 | 7.1 | 42 |
| | 6 | Production Example 1 | Production Example 8 | 12 | 61 | presence | after coil | 1 | 6.8 | 41 |
| | 7 | Production Example 1 | Production Example 3 | 15 | 61 | presence | after coil | 1 | 6.5 | 30 |
| | 8 | Production Example 1 | Production Example 7 | 15 | 61 | presence | after coil | 1 | 6.5 | 30 |

In Comparative Example 1, since the heating temperature is lower than the glass transition temperature of the core particle, shell particles do not uniformly coat the surface of the core particle and the exposed portion on the surface of the core particle was large to result in poor encapsulation. In Comparative Example 2, since a high pressure homogenizer not having the coiled pipeline was utilized, the encapsulation was insufficient like in Comparative Example 1. Since Comparative Example 3 used a high pressure homogenizer in which the position for the coiled pipeline and the depressurizing module was reversed, encapsulation was poor like in Comparative Example 1. In Comparative Example 4, since the heating temperature is higher than the melting point of the core particle, aggregation occurred between the core particles to each other. In Comparative Example 5, since the heating temperature is higher than the glass transition temperature of the shell particle, aggregation occurred between the shell particles to each other. In Comparative Example 6, since the difference of the glass transition temperature between the core particle and the shell particle is less than 15° C., encapsulation was poor like in Comparative Example 1. In Comparative Example 7, since relatively large shell particles of 1.11 μm in Production Example 3 were used, they could not uniformly coat the surface of the particle and the encapsulation was not sufficient. In Comparative Example 8, since the relatively small shell particles of 0.49 μm of Production Example 7 were used, the shell layer could not be formed uniformly and encapsulation was poor since the surface area per unit mass was increased in a case where the particles were excessively small and the dispersion stability in the liquid was worsened.

The invention can be practiced in other various forms without departing from the gist or principal feature thereof. Accordingly, the embodiments described above are merely illustration in all respects and the range of the invention is shown as in the scope of the claim for patent and is not restricted at all to the description of the specification. Further, all modifications and changes included in the scope of the claim for Patent are within the range of the invention.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A method of manufacturing a functional particle comprising a step of flowing a mixed slurry containing a core particle as a resin particle and a shell particle of a resin particle having a volume average particle size less than that of the core particle through a coiled pipeline while heating the mixed slurry to a glass transition temperature or higher of the core particle, thereby obtaining a functional particle in which the shell particle is deposited on a surface of the core particle, wherein the heating temperature A of the mixed slurry containing the core particles and the shell particles in the coiled pipeline satisfies the following relation:

$$Tg(c)<A<Tg(s)<Mp(c) \quad (1)$$

where Tg(c) represents a glass transition temperature of a core particle, Tg(s) shows a glass transition temperature of a shell particle, and Mp(c) represents the melting point of the core particle).

2. The method of claim 1, further comprising:

a depressurizing step of reducing a pressure of a slurry containing functional particles so as not to cause bubbling due to bumping and;

a cooling step of cooling the slurry containing the functional particles.

3. The method of claim 1, wherein the core particles and the shell particles satisfy the following relation:

$$Tg(s)-Tg(c)\geqq 15(^\circ\ C.) \quad (2).$$

4. The method of claim 1, wherein a volume average grain size of the core particle is in a range of from 3.0 to 6.0 μm and a volume average grain size of the shell particle is in a range of from 0.01 to 1.0 μm.

5. The method of claim 1, wherein the core particle contains a colorant and a release agent together with a synthetic resin.

* * * * *